US010152957B2

(12) United States Patent
Lenhert

(10) Patent No.: US 10,152,957 B2
(45) Date of Patent: Dec. 11, 2018

(54) METHODS AND DEVICES FOR MODULATING THE TEMPO OF MUSIC IN REAL TIME BASED ON PHYSIOLOGICAL RHYTHMS

(71) Applicant: Steven Lenhert, Tallahassee, FL (US)

(72) Inventor: Steven Lenhert, Tallahassee, FL (US)

( * ) Notice: Subject to any disclaimer, the term of this patent is extended or adjusted under 35 U.S.C. 154(b) by 0 days.

(21) Appl. No.: 15/419,079

(22) Filed: Jan. 30, 2017

(65) Prior Publication Data

US 2017/0221463 A1 Aug. 3, 2017

Related U.S. Application Data

(60) Provisional application No. 62/288,524, filed on Jan. 29, 2016.

(51) Int. Cl.
*G10H 1/00* (2006.01)
*G10H 1/40* (2006.01)

(52) U.S. Cl.
CPC ..... *G10H 1/0025* (2013.01); *G10H 1/40* (2013.01); *G10H 2210/391* (2013.01); *G10H 2220/311* (2013.01); *G10H 2220/371* (2013.01); *G10H 2220/376* (2013.01); *G10H 2240/175* (2013.01)

(58) Field of Classification Search
CPC .. G10H 1/0025; G10H 1/40; G10H 2210/391; G10H 2220/371; G10H 2220/376
USPC ..... 84/612
See application file for complete search history.

(56) References Cited

U.S. PATENT DOCUMENTS 5,267,942 A * 12/1993 Saperston ..... A61M 21/02 128/905
5,800,337 A * 9/1998 Gavish ..... A61B 5/1135 600/27
6,090,037 A * 7/2000 Gavish ..... A61B 5/1135 600/27
6,662,032 B1 * 12/2003 Gavish ..... A61B 5/0205 600/300
2001/0015123 A1 * 8/2001 Nishitani ..... A63B 71/0686 84/615
2006/0102171 A1 * 5/2006 Gavish ..... A61B 5/0816 128/95.1
2006/0111621 A1 * 5/2006 Coppi ..... A61B 5/222 600/300
2007/0113725 A1 * 5/2007 Oliver ..... A61B 5/02438 84/612
2007/0113726 A1 * 5/2007 Oliver ..... A61B 5/0006 84/615
2007/0118043 A1 * 5/2007 Oliver ..... A61B 5/0245 600/519
2009/0158920 A1 * 6/2009 Itami ..... A63B 24/0062 84/645
2009/0260506 A1 * 10/2009 Saperston ..... A63B 71/0686 84/612
2010/0037753 A1 * 2/2010 Wagner ..... A61B 5/0205 84/612

(Continued)

FOREIGN PATENT DOCUMENTS

JP 08075875 A * 3/1996

*Primary Examiner* — Daivd Warren
*Assistant Examiner* — Christina Schreiber
(74) *Attorney, Agent, or Firm* — Ajay A. Jagtiani

(57) ABSTRACT

Described are methods and devices for modulating the tempo of music in real time based on physiological rhythms.

37 Claims, 28 Drawing Sheets

(56) References Cited

U.S. PATENT DOCUMENTS

| | | | | |
|---|---|---|---|---|
| 2014/0141395 | A1* | 5/2014 | Gavish | A61B 5/0205<br>434/236 |
| 2016/0055420 | A1* | 2/2016 | Karanam | G06F 19/00<br>700/52 |
| 2017/0221463 | A1* | 8/2017 | Lenhert | G10H 1/0025 |

* cited by examiner

METHODS AND DEVICES FOR MODULATING THE TEMPO OF MUSIC IN REAL TIME BASED ON PHYSIOLOGICAL RHYTHMS

CROSS-REFERENCE TO RELATED APPLICATIONS

This application claims benefit of priority to U.S. Provisional Patent Application No. 62/288,524 to Lenhert, entitled, "METHODS AND DEVICES FOR MODULATING THE TEMPO OF MUSIC IN REAL TIME BASED ON PHYSIOLOGICAL RHYTHMS," filed Jan. 29, 2016 which is incorporated herein by reference in its entirety.

BACKGROUND

Field of the Invention

The present invention relates to generally to a method and device.

Background of the Invention

There are problems with existing devices and methods for modulating the tempo of music being played by a musician, electronically produced music and prerecorded music.

SUMMARY

According to a first broad aspect, the present invention provides a device comprising a physiological metronome configured to control the tempo of music performed based on a physiological rhythm of a musician or based on a physiological rhythm of one or more members of an audience listening to the music performed.

According to a second broad aspect, the present invention provides a device configured to play music at a tempo based on a physiological rhythm of one or more members of an audience listening to music played by the device.

According to a third broad aspect, the present invention provides a device configured to synchronize, and allow phase and gain adjustments of music played by the device based on a physiological rhythm of one or more members of an audience listening to the music played by the device.

According to a fourth broad aspect, the present invention provides a device configured to play recordings of music at one or more speeds based on a physiological rhythm of one or more members of an audience listening to the music played by the device.

According to a fifth broad aspect, the present invention provides a device configured to adjust music played on the device by a musician based on a physiological rhythm of one or more members of an audience listening to the music played on the device.

According to a sixth broad aspect, the present invention provides a device configured to adjust the tuning of the music played by the device based on a physiological rhythm of one or more members of an audience listening to the music played by the device.

According to a seventh broad aspect, the present invention provides a method comprising synchronizing tempo of music played by a musician with a physiological rhythm of the musician or with a physiological rhythm of one or more audience members listening to the music.

According to an eighth broad aspect, the present invention provides a method comprising predicting in real time beats of music played by a musician based on a physiological rhythm of the musician or based on a physiological rhythm of one or more audience members listening to the music.

According to a ninth broad aspect, the present invention provides a method comprising determining an error between predicted beats of music played by a musician and actual beats of music played by the musician, wherein the predicted beats of music played by the musician are based on a physiological rhythm of the musician or based on a physiological rhythm of one or more audience members listening to the music.

According to a tenth broad aspect, the present invention provides a method comprising phase shifting music played by a musician based on a physiological rhythm of the musician or based on a physiological rhythm of one or more audience members listening to the music.

According to an eleventh broad aspect, the present invention provides a method comprising increasing or decreasing tempo of music played by a musician based on a physiological rhythm of the musician or based on a physiological rhythm of one or more audience members listening to the music.

According to an twelfth broad aspect, the present invention provides a method comprising integrating multiple waveforms from multiple listeners of music by carrying out mathematically weighted operations between the waveforms to generate a single waveform.

According to an thirteenth broad aspect, the present invention provides a method comprising integrating multiple waveforms from multiple listeners of music by determining a predicted interval for each waveform and averaging the predictions to generate a single waveform.

According to a fourteenth broad aspect, the present invention provides a method comprising tuning music listened to by one or more listeners to match physiological rhythms of the one or more listeners.

According to a fifteenth broad aspect, the present invention provides a method comprising playing music at a different musical pattern based on a change in the physiological rhythms of one or more listeners listening to the music.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

FIG. 22 is a drawing of two graphs of two different physiological rhythms according embodiments of the present invention.

DETAILED DESCRIPTION OF THE INVENTION

Definitions

Figure 1:
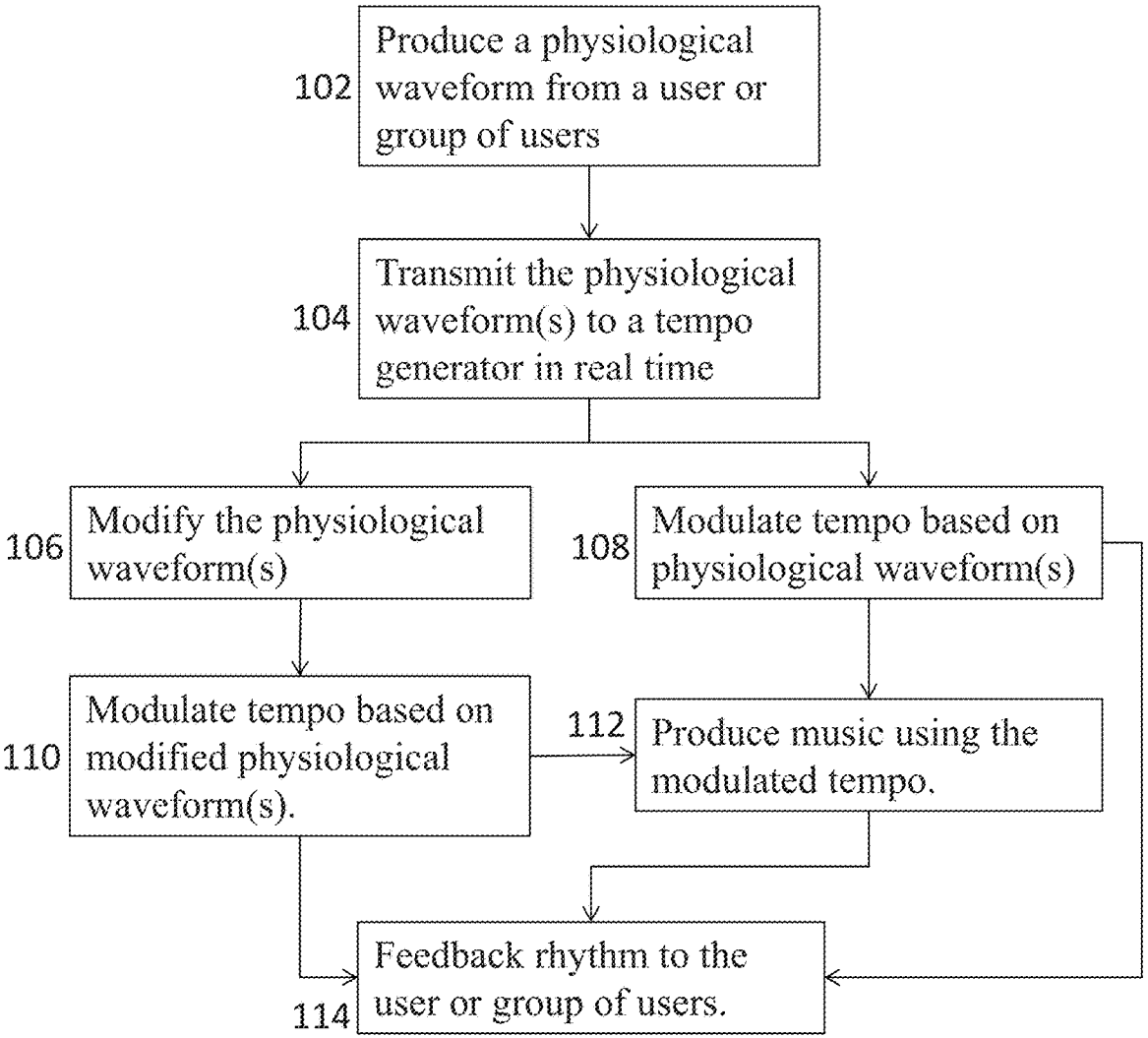
FIG. 1 is a flowchart showing the major components of the physiological metronome according to one embodiment of the present invention.

Where the definition of terms departs from the commonly used meaning of the term, applicant intends to utilize the definitions provided below, unless specifically indicated.

It is to be understood that the foregoing general description and the following detailed description are exemplary and explanatory only and are not restrictive of any subject matter claimed. In this application, the use of the singular includes the plural unless specifically stated otherwise. It must be noted that, as used in the specification and the appended claims, the singular forms "a," "an" and "the" include plural referents unless the context clearly dictates otherwise. In this application, the use of "or" means "and/or" unless stated otherwise. Furthermore, use of the term "including" as well as other forms, such as "include", "includes," and "included," is not limiting.

For purposes of the present invention, the term "comprising", the term "having", the term "including," and variations of these words are intended to be open-ended and mean that there may be additional elements other than the listed elements.

For purposes of the present invention, directional terms such as "top," "bottom," "upper," "lower," "above," "below," "left," "right," "horizontal," "vertical," "up," "down," etc., are used merely for convenience in describing the various embodiments of the present invention. The embodiments of the present invention may be oriented in various ways. For example, the diagrams, apparatuses, etc., shown in the drawing figures may be flipped over, rotated by 90° in any direction, reversed, etc.

For purposes of the present invention, a value or property is "based" on a particular value, property, the satisfaction of a condition, or other factor, if that value is derived by performing a mathematical calculation or logical decision using that value, property or other factor.

For purposes of the present invention, it should be noted that to provide a more concise description, some of the quantitative expressions given herein are not qualified with the term "about." It is understood that whether the term "about" is used explicitly or not, every quantity given herein is meant to refer to the actual given value, and it is also meant to refer to the approximation to such given value that would reasonably be inferred based on the ordinary skill in the art, including approximations due to the experimental and/or measurement conditions for such given value.

For purposes of the present invention, the term "associated" with respect to data refers to data that are associated or linked to each other. For example, data relating the identity of an individual (identity data) wearing an integrated sensor module may be associated with the motion data for the individual obtained from an accelerometer or, optionally, from a gyroscope or, optionally, from the amplitude of the power signal from an energy harvester.

For purposes of the present invention, the term "biocompatible coating" refers to a coating that is suitable for contact with biological tissue without causing damage to that tissue.

For purposes of the present invention, the term "blood constituent concentrations" refers to concentrations of components in blood such as oxygen, carbon dioxide, urea, glucose, hormones, or other constituents.

For purposes of the present invention, the term "brainwaves" refers to electrical impulses in the brain, such as those detected by electroencephelocardiography.

For purposes of the present invention, the term "computer" refers to any type of computer or other device that implements software including an individual computer such as a personal computer, laptop computer, tablet computer, mainframe computer, mini-computer, etc. A computer also refers to electronic devices such as an electronic scientific instrument such as a spectrometer, a smartphone, an eBook reader, a cell phone, a television, a handheld electronic game console, a videogame console, a compressed audio or video player such as an MP3 player, a Blu-ray player, a DVD player, etc. In addition, the term "computer" refers to any type of network of computers, such as a network of computers in a business, a computer bank, the Cloud, the Internet, etc. Various processes of the present invention may be carried out using a computer. Various functions of the present invention may be performed by one or more computers.

For purposes of the present invention, the term "dotted notes" refers to a musical note with a dot after it indicating an extension of the time interval indicated by the note by an additional one half of the time indicated by the note. For instance, a dotted quarter note at a 4/4 tempo with a regular speed of 60 beats per minute would last 1.5 seconds instead of the 1 second that an undotted quarter note would last.

For purposes of the present invention, the term "electrocardiography (ECG)" refers to the measurement of electrical activity in the heart and the recording of such activity.

For purposes of the present invention, the term "electrocardiography (ECG) metronome" refers to a physiological metronome that uses one or more measurements of electrical activity in the heart to mark time in music, either by giving a signal to the musician at intervals based on the one or more measurement of electrical activity in the heart or by controlling the tempo of electronically produced music based on the one or more measurement of electrical activity in the heart.

For purposes of the present invention, the term "electroencephalography (EEG)" refers to the measurement of electrical activity in different parts of the brain and the recording of such activity.

For purposes of the present invention, the term "electronic data processor" refers to a device capable of processing data by carrying out one or more logical functions or algorithms.

For purposes of the present invention, the term "hardware and/or software" refers to functions that may be performed by digital software, digital hardware, or a combination of both digital hardware and digital software. Various features of the present invention may be performed by hardware and/or software.

For purposes of the present invention, the term "hormonal concentrations" refers to the concentrations long distance signaling molecules, i.e. hormones.

For purposes of the present invention, the term "individual" refers to an individual mammal, such as a human being.

For purposes of the present invention, the term "machine-readable medium" refers to any tangible or non-transitory medium that is capable of storing, encoding or carrying instructions for execution by the machine and that cause the machine to perform any one or more of the methodologies of the present invention, or that is capable of storing, encoding or carrying data structures utilized by or associated with such instructions. The term "machine-readable medium" includes, but is limited to, solid-state memories, and optical and magnetic media. Specific examples of machine-readable media include non-volatile memory, including by way of example, semiconductor memory devices, e.g., EPROM, EEPROM, and flash memory devices; magnetic disks such as internal hard disks and removable disks; magneto-optical disks; and CD-ROM and DVD-ROM disks. The term "machine-readable medium" may include a single medium or multiple media (e.g., a centralized or distributed database, and/or associated caches and servers) that store the one or more instructions or data structures.

For purposes of the present invention, the term "metronome" refers to a device used by a musician that marks time in music by giving a signal to the musician at intervals synchronized with the tempo of the music. The signal may be given to the musician in a variety of ways such as by a visual signal, an audible signal, a signal that is felt by the musician, etc. While traditional metronomes mark time in regular time intervals, in one embodiment, the present invention varies the time intervals based on physiological input. A metronome may be mechanical or electrical. The functions of a metronome may be carried out in a variety of ways such as by software program on a computer, by an application on a smartphone, etc.

For purposes of the present invention, the term "modulated rhythm" refers to a rhythm whose tempo or speed is modulated or changed in real time.

For purposes of the present invention, the term "modulated tempo" refers to changes in the tempo of a song as the song is played. Examples of modulated tempo in music include "ritardando" or gradually becoming slower, "ritenuto" or quickly becoming slower, "accelerando" meaning gradually becoming faster, and "molto accelerando" or quickly becoming faster. The rates at which a tempo is modulated can be indicated by modifiers such as "poco a poco" meaning gradually, "poco" meaning a little more, or "piu" meaning more. Another way to modulate tempo is by "rubato" which indicates a speeding up and/or slowing down of a musical passage. Rubato can also be carried out over short timescales, for instance, where the duration of just a few, or even one note might be slightly longer, and then the duration of just a few or even one note might be slightly faster so that the total time of the passage or couple of notes is the same as if each note was played precisely at its designated time interval.

For purposes of the present invention, the term "musical rhythms" refers to the relative timing of musical notes and beats in a passage of music.

For purposes of the present invention, the term "non-transient storage medium" refers to a storage medium that is non-transitory, tangible and computer readable. Non-transient storage medium may refer generally to any durable medium known in the art upon which data can be stored and later retrieved by data processing circuitry operably coupled with the medium. A non-limiting non-exclusive list of exemplary non-transitory data storage media may include magnetic data storage media (e.g., hard disc, data tape, etc.), solid state semiconductor data storage media (e.g., SDRAM, flash memory, ROM, etc.), and optical data storage media (e.g., compact optical disc, DVD, etc.).

For purposes of the present invention, the term "phase shifting" refers to changes in the relative timing of two waveforms. For instance, two waveforms with regular minima and maxima that occur at the same time are in phase. Two waveforms with regular minima and maxima that occur at different times are out of phase. Shifting the phase means to shift one of the waveforms relative to the other in time so that they become more or less in phase.

For purposes of the present invention, the term "photoplethysmography (PPG)" refers to the conventional meaning of the term "photoplethysmography (PPG)," i.e., a measurement of blood flow or blood pressure by optical means (typically involving measurement of changes in the transmission or scattering of light created by blood flow in a part of the body).

For purposes of the present invention, the term "photoplethysmography (PPG) metronome" refers to a physiological metronome that uses one or more measurements of blood flow or blood pressure to mark time in music, either by giving a signal to the musician at intervals based on one or more measurements of blood flow or blood pressure or by controlling the tempo of electronically produced music based one or more measurements of blood flow or blood pressure.

For purposes of the present invention, the term "physiological amplitudes" refers to the amplitudes of a measured physiological state at various times. For example, in the context of a PPG waveform measured with a pulse oximeter, the physiological amplitude could represent the tissue absorption of light at any particular time. In the case of an electrical measurement such as ECG or EEG, a voltage measured at a particular time could be an example of a physiological amplitude.

For purposes of the present invention, the term "physiological interval" refers to a time interval between two physiological events. For example, the time elapsed between two consecutive peaks in a PPG, ECG or EEG waveform would be a physiological interval.

For purposes of the present invention, the term "physiological metronome" refers to a device that uses physiological input as a basis to mark time in music, either by giving a signal to the musician at intervals determined by physiological input or by controlling the tempo of electronically produced music. The signal may be given to the musician in a variety of ways such as by a visual signal, an audible signal, a signal that is felt by the musician, etc. A physiological metronome may be mechanical or electrical. The functions of a physiological metronome may be carried out in a variety of ways such as by software program on a computer, by an application on a smartphone, etc. Examples of physiological metronomes include a photoplethysmography (PPG) metronome, an electrocardiography (ECG) metronome, etc.

For purposes of the present invention, the term "physiological rhythm" refers to a physically detectable property of or event taking place in an organism, typically human, that periodically repeats at semi-regular intervals in time. In one embodiment, the present invention involves those physiological rhythms that take place at timescales relevant to musical rhythms and acoustic frequencies, for instance heartbeat, blood pressure, breathing rates, brainwaves.

For purposes of the present invention, the term "physiological waveform" refers to a recording of a physiological rhythm that can be represented as a measurable physiological property or event taking place in an organism, typically human, plotted versus time. Examples of physiological waveforms include: a pulse plethysmograph, an electrocardiograph, an electroencephelocardiograph, etc.

For purposes of the present invention, the term "processor" refers to a device that performs the basic operations in a computer. A microprocessor is one example of a processor.

For purposes of the present invention, the term "real time display" refers to a display that shows the user events in real time.

For purposes of the present invention, the term "real time" refers to the conventional meaning of the term "real time," i.e., reporting, depicting, or reacting to events at the same rate and sometimes at the same time as they unfold, rather than compressing a depiction or delaying a report or action.

For purposes of the present invention, the term "rhythm" used in the context of music refers to a repeated pattern of sounds in time.

For purposes of the present invention, the term "storage medium" refers to any form of storage that may be used to store bits of information. Examples of storage media include both volatile and non-volatile memories such as MRRAM, MRRAM, ERAM, flash memory, RFID tags, floppy disks, Zip™ disks, CD-ROM, CD-R, CD-RW, DVD, DVD-R, flash memory, hard disks, optical disks, etc. Two or more storage media acting similarly to a single data storage medium may be referred to as a "storage medium" for the purposes of the present invention. A storage medium may be part of a computer.

For purposes of the present invention, the term "tactile indicators" refers to a signal sent to a user in the form of physical contact, for instance by mechanical vibration on the users skin.

For purposes of the present invention, the term "tactile information" refers to information that is contained in a tactile form, for instance information transmitted by a tactile.

For purposes of the present invention, the term "tactile rhythm communicator" refers to a device that sends tactile indicators to a user to communicate information.

For purposes of the present invention, the term "tempo generator" refers to a device that generates tempo. For example a tempo generator could take the input from a physiological rhythm to produce a tempo that remains synchronized with a physiological rhythm that may change with time.

For purposes of the present invention, the term "tempo" refers to the conventional meaning of the term "tempo," i.e. the speed at which a passage of music is or should be played.

For example, a tempo of 60 beats per minute indicates that the time interval for 60 quarter notes should pass in one minute, or one quarter note per second.

For purposes of the present invention, the term "triplet" refers to the subdivision of a musical time interval into three equal sub-intervals.

For purposes of the present invention, the term "visual information" refers to information that is contained in a visual form, such as information projected by a display screen that could communicate information visually to a user.

For the purposes of the current invention, the term "low powered wireless network" refers to an ultra-low powered wireless network between sensor nodes and a centralized device. The ultra-low power is needed by devices that need to operate for extended periods of time from small batteries energy scavenging technology. Examples of low powered wireless networks are ANT, ANT+, Bluetooth Low Energy (BLE), ZigBee and WiFi.

For the purposes of the present invention the term "mesh networking" refers to a type of networking where each node must not only capture and disseminate its own data, but also serve as a relay for other nodes, that is, it must collaborate to propagate the data in the network. A mesh network can be designed using a flooding technique or a routing technique. When using a routing technique, the message is propagated along a path, by hopping from node to node until the destination is reached. To ensure all its paths' availability, a routing network must allow for continuous connections and reconfiguration around broken or blocked paths, using self-healing algorithms. A mesh network whose nodes are all connected to each other is a fully connected network. Mesh networks can be seen as one type of ad hoc network. Mobile ad hoc networks and mesh networks are therefore closely related, but mobile ad hoc networks also have to deal with the problems introduced by the mobility of the nodes. The self-healing capability enables a routing based network to operate when one node breaks down or a connection goes bad. As a result, the network is typically quite reliable, as there is often more than one path between a source and a destination in the network. Although mostly used in wireless situations, this concept is also applicable to wired networks and software interaction.

For the purposes of the present invention the term "mobile ad hoc network" is a self-configuring infrastructureless network of mobile devices connected by wireless. Ad hoc is Latin and means "for this purpose". Each device in a mobile ad hoc network is free to move independently in any direction, and will therefore change its links to other devices frequently. Each must forward traffic unrelated to its own use, and therefore be a router. The primary challenge in building a mobile ad hoc network is equipping each device to continuously maintain the information required to properly route traffic. Such networks may operate by themselves or may be connected to the larger Internet. Mobile ad hoc networks are a kind of wireless ad hoc networks that usually has a routable networking environment on top of a Link Layer ad hoc network. The growths of laptops and wireless networks have made mobile ad hoc networks a popular research topic since the mid-1990s. Many academic papers evaluate protocols and their abilities, assuming varying degrees of mobility within a bounded space, usually with all nodes within a few hops of each other. Different protocols are then evaluated based on measure such as the packet drop rate, the overhead introduced by the routing protocol, end-to-end packet delays, network throughput etc.

For the purposes of the present invention, the term "Bluetooth®" refers to a wireless technology standard for exchanging data over short distances (using short-wavelength radio transmissions in the ISM band from 2400-2480 MHz) from fixed and mobile devices, creating personal area networks (PANs) with high levels of security. Created by telecom vendor Ericsson in 1994, it was originally conceived as a wireless alternative to RS-232 data cables. It can connect several devices, overcoming problems of synchronization. Bluetooth® is managed by the Bluetooth® Special Interest Group, which has more than 18,000 member companies in the areas of telecommunication, computing, networking, and consumer electronics. Bluetooth® was standardized as IEEE 802.15.1, but the standard is no longer maintained. The SIG oversees the development of the specification, manages the qualification program, and protects the trademarks. To be marketed as a Bluetooth® device, it must be qualified to standards defined by the SIG. A network of patents is required to implement the technology and are licensed only for those qualifying devices.

For the purposes of the present invention, the term "cloud computing" is synonymous with computing performed by computers that are located remotely and accessed via the Internet (the "Cloud"). It is a style of computing where the computing resources are provided "as a service", allowing users to access technology-enabled services "in the cloud" without knowledge of, expertise with, or control over the technology infrastructure that supports them. According to the IEEE Computer Society it "is a paradigm in which information is permanently stored in servers on the Internet and cached temporarily on clients that include desktops, entertainment centers, table computers, notebooks, wall computers, handhelds, etc." Cloud computing is a general concept that incorporates virtualized storage, computing and web services and, often, software as a service (SaaS), where the common theme is reliance on the Internet for satisfying the computing needs of the users. For example, Google Apps provides common business applications online that are accessed from a web browser, while the software and data are stored on the servers. Some successful cloud architectures may have little or no established infrastructure or billing systems whatsoever including Peer-to-peer networks like BitTorrent and Skype and volunteer computing like SETI@home. The majority of cloud computing infrastructure currently consists of reliable services delivered through next-generation data centers that are built on computer and storage virtualization technologies. The services may be accessible anywhere in the world, with the Cloud appearing as a single point of access for all the computing needs of data consumers. Commercial offerings may need to meet the quality of service requirements of customers and may offer service level agreements. Open standards and open source software are also critical to the growth of cloud computing. As customers generally do not own the infrastructure, they are merely accessing or renting, they may forego capital expenditure and consume resources as a service, paying instead for what they use. Many cloud computing offerings have adopted the utility computing model which is analogous to how traditional utilities like electricity are consumed, while others are billed on a subscription basis. By sharing "perishable and intangible" computing power between multiple tenants, utilization rates may be improved (as servers are not left idle) which can reduce costs significantly while increasing the speed of application development. A side effect of this approach is that "computer capacity rises dramatically" as customers may not have to engineer for peak loads. Adoption has been enabled by "increased high-speed bandwidth" which makes it possible to receive the same response times from centralized infrastructure at other sites.

For the purposes of the present invention, the term "computer hardware" and the term "hardware" refer to the digital circuitry and physical devices of a computer system, as opposed to computer software, which is stored on a hardware device such as a hard disk. Most computer hardware is not seen by normal users, because it is embedded within a variety of every day systems, such as in automobiles, microwave ovens, electrocardiograph machines, compact disc players, and video games, among many others. A typical personal computer consists of a case or chassis in a tower shape (desktop) and the following parts: motherboard, CPU, RAM, firmware, internal buses (PIC, PCI-E, USB, HyperTransport, CSI, AGP, VLB), external bus controllers (parallel port, serial port, USB, Firewire, SCSI. PS/2, ISA, EISA, MCA), power supply, case control with cooling fan, storage controllers (CD-ROM, DVD, DVD-ROM, DVD Writer, DVD RAM Drive, Blu-ray, BD-ROM, BD Writer, floppy disk, USB Flash, tape drives, SATA, SAS), video controller, sound card, network controllers (modem, NIC), and peripherals, including mice, keyboards, pointing devices, gaming devices, scanner, webcam, audio devices, printers, monitors, etc.

For the purposes of the present invention, the term "computer network" refers to a group of interconnected computers. Networks may be classified according to a wide variety of characteristics. The most common types of computer networks in order of scale include: Personal Area Network (PAN), Local Area Network (LAN), Campus Area Network (CAN), Metropolitan Area Network (MAN), Wide Area Network (WAN), Global Area Network (GAN), Internetwork (intranet, extranet, Internet), and various types of wireless networks. All networks are made up of basic hardware building blocks to interconnect network nodes, such as Network Interface Cards (NICs), Bridges, Hubs, Switches, and Routers. In addition, some method of connecting these building blocks is required, usually in the form of galvanic cable (most commonly category 5 cable). Less common are microwave links (as in IEEE 802.11) or optical cable ("optical fiber").

For the purposes of the present invention, the term "computer software" and the term "software" refers to one or more computer programs, procedures and documentation that perform some tasks on a computer system. The term includes application software such as word processors which perform productive tasks for users, system software such as operating systems, which interface with hardware to provide the necessary services for application software, and middleware which controls and co-ordinates distributed systems. Software may include websites, programs, video games, etc. that are coded by programming languages like C, C++, Java, etc. Computer software is usually regarded as anything but hardware, meaning the "hard" are the parts that are tangible (able to hold) while the "soft" part is the intangible objects inside the computer. Computer software is so called to distinguish it from computer hardware, which encompasses the physical interconnections and devices required to store and execute (or run) the software. At the lowest level, software consists of a machine language specific to an individual processor. A machine language consists of groups of binary values signifying processor instructions which change the state of the computer from its preceding state.

For the purposes of the present invention, the term "computer system" refers to any type of computer system that implements software including an individual computer such as a personal computer, mainframe computer, mini-computer, etc. In addition, computer system refers to any type of network of computers, such as a network of computers in a business, the Internet, personal data assistant (PDA), devices such as a cell phone, a television, a videogame console, a compressed audio or video player such as an MP3 player, a DVD player, a microwave oven, etc. A personal computer is one type of computer system that typically includes the following components: a case or chassis in a tower shape (desktop) and the following parts: motherboard, CPU, RAM, firmware, internal buses (PIC, PCI-E, USB, HyperTransport, CSI, AGP, VLB), external bus controllers (parallel port, serial port, USB, Firewire, SCSI. PS/2, ISA, EISA, MCA), power supply, case control with cooling fan, storage controllers (CD-ROM, DVD, DVD-ROM, DVD Writer, DVD RAM Drive, Blu-ray, BD-ROM, BD Writer, floppy disk, USB Flash, tape drives, SATA, SAS), video controller, sound card, network controllers (modem, NIC), and peripherals, including mice, keyboards, pointing devices, gaming devices, scanner, webcam, audio devices, printers, monitors, etc.

For the purposes of the present invention, the term "data storage medium" or "data storage device" refers to any medium or media on which a data may be stored for use by a computer system. Examples of data storage media include floppy disks, Zip™ disks, CD-ROM, CD-R, CD-RW, DVD, DVD-R, memory sticks, flash memory, hard disks, solid state disks, optical disks, etc. Two or more data storage media acting similarly to a single data storage medium may be referred to as a "data storage medium" for the purposes of the present invention. A data storage medium may be part of a computer.

For the purposes of the present invention, the term "data" means the reinterpretable representation of information in a formalized manner suitable for communication, interpretation, or processing. Although one type of common type data is a computer file, data may also be streaming data, a web service, etc. The term "data" is used to refer to one or more pieces of data.

For the purposes of the present invention, the term "database management system (DBMS)" represents computer software designed for the purpose of managing databases based on a variety of data models. A DBMS is a set of software programs that controls the organization, storage, management, and retrieval of data in a database. DBMS are categorized according to their data structures or types. It is a set of prewritten programs that are used to store, update and retrieve a Database.

For the purposes of the present invention, the term "database" or "data record" refers to a structured collection of records or data that is stored in a computer system. The structure is achieved by organizing the data according to a database model. The model in most common use today is the relational model. Other models such as the hierarchical model and the network model use a more explicit representation of relationships (see below for explanation of the various database models). A computer database relies upon software to organize the storage of data. This software is known as a database management system (DBMS). Database management systems are categorized according to the database model that they support. The model tends to determine the query languages that are available to access the database. A great deal of the internal engineering of a DBMS, however, is independent of the data model, and is concerned with managing factors such as performance, concurrency, integrity, and recovery from hardware failures. In these areas there are large differences between products.

For the purposes of the present invention, the term "Internet protocol (IP)" refers to a protocol used for communicating data across a packet-switched internetwork using the Internet Protocol Suite (TCP/IP). IP is the primary protocol in the Internet Layer of the Internet Protocol Suite and has the task of delivering datagrams (packets) from the source host to the destination host solely based on its address. For this purpose the Internet Protocol defines addressing methods and structures for datagram encapsulation. The first major version of addressing structure, now referred to as Internet Protocol Version 4 (Ipv4) is still the dominant protocol of the Internet, although the successor, Internet Protocol Version 6 (Ipv6) is actively deployed world-wide. In one embodiment, an EGI-SOA of the present invention may be specifically designed to seamlessly implement both of these protocols.

For the purposes of the present invention, the term "Internet" is a global system of interconnected computer networks that interchange data by packet switching using the standardized Internet Protocol Suite (TCP/IP). It is a "network of networks" that consists of millions of private and public, academic, business, and government networks of local to global scope that are linked by copper wires, fiber-optic cables, wireless connections, and other technologies. The Internet carries various information resources and services, such as electronic mail, online chat, file transfer and file sharing, online gaming, and the inter-linked hypertext documents and other resources of the World Wide Web (WWW).

For the purposes of the present invention, the term "intranet" refers to a set of networks, using the Internet Protocol and IP-based tools such as web browsers and file transfer applications that are under the control of a single administrative entity. That administrative entity closes the intranet to all but specific, authorized users. Most commonly, an intranet is the internal network of an organization. A large intranet will typically have at least one web server to provide users with organizational information. Intranets may or may not have connections to the Internet. If connected to the Internet, the intranet is normally protected from being accessed from the Internet without proper authorization. The Internet is not considered to be a part of the intranet.

For the purposes of the present invention, the term "local area network (LAN)" refers to a network covering a small geographic area, like a home, office, or building. Current LANs are most likely to be based on Ethernet technology. The cables to the servers are typically on Cat 5e enhanced cable, which will support IEEE 802.3 at 1 Gbit/s. A wireless LAN may exist using a different IEEE protocol, 802.11b, 802.11g or possibly 802.11n. The defining characteristics of LANs, in contrast to WANs (wide area networks), include their higher data transfer rates, smaller geographic range, and lack of a need for leased telecommunication lines. Current Ethernet or other IEEE 802.3 LAN technologies operate at speeds up to 10 Gbit/s.

For the purposes of the present invention, the term "MEMS" refers to Micro-Electro-Mechanical Systems. MEMS, is a technology that in its most general form may be defined as miniaturized mechanical and electro-mechanical elements (i.e., devices and structures) that are made using the techniques of microfabrication. The critical physical dimensions of MEMS devices can vary from well below one micron on the lower end of the dimensional spectrum, all the way to several millimeters. Likewise, the types of MEMS devices can vary from relatively simple structures having no moving elements, to extremely complex electromechanical systems with multiple moving elements under the control of integrated microelectronics. A main criterion of MEMS may include that there are at least some elements having some sort of mechanical functionality whether or not these elements can move. The term used to define MEMS varies in different parts of the world. In the United States they are predominantly called MEMS, while in some other parts of the world they are called "Microsystems Technology" or "micromachined devices." While the functional elements of MEMS are miniaturized structures, sensors, actuators, and microelectronics, most notable elements may include microsensors and microactuators. Microsensors and microactuators may be appropriately categorized as "transducers," which are defined as devices that convert energy from one form to another. In the case of microsensors, the device typically converts a measured mechanical signal into an electrical signal.

For the purposes of the present invention, the term "network hub" refers to an electronic device that contains multiple ports. When a packet arrives at one port, it is copied to all the ports of the hub for transmission. When the packets are copied, the destination address in the frame does not change to a broadcast address. It does this in a rudimentary way, it simply copies the data to all of the Nodes connected to the hub. This term is also known as hub. The term "Ethernet hub," "active hub," "network hub," "repeater hub," "multiport repeater" or "hub" may also refer to a device for connecting multiple Ethernet devices together and making them act as a single network segment. It has multiple input/output (I/O) ports, in which a signal introduced at the input of any port appears at the output of every port except the original incoming. A hub works at the physical layer (layer 1) of the OSI model. The device is a form of multiport repeater. Repeater hubs also participate in collision detection, forwarding a jam signal to all ports if it detects a collision.

For the purposes of the present invention, the term "random-access memory (RAM)" refers to a type of computer data storage. Today it takes the form of integrated circuits that allow the stored data to be accessed in any order, i.e. at random. The word random thus refers to the fact that any piece of data can be returned in a constant time, regardless of its physical location and whether or not it is related to the previous piece of data. This contrasts with storage mechanisms such as tapes, magnetic discs and optical discs, which rely on the physical movement of the recording medium or a reading head. In these devices, the movement takes longer than the data transfer, and the retrieval time varies depending on the physical location of the next item. The word RAM is mostly associated with volatile types of memory (such as DRAM memory modules), where the information is lost after the power is switched off. However, many other types of memory are RAM as well, including most types of ROM and a kind of flash memory called NOR-Flash.

For the purposes of the present invention, the term "read-only memory (ROM)" refers to a class of storage media used in computers and other electronic devices. Because data stored in ROM cannot be modified (at least not very quickly or easily), it is mainly used to distribute firmware (software that is very closely tied to specific hardware, and unlikely to require frequent updates). In its strictest sense, ROM refers only to mask ROM (the oldest type of solid state ROM), which is fabricated with the desired data permanently stored in it, and thus can never be modified. However, more modern types such as EPROM and flash EEPROM can be erased and re-programmed multiple times; they are still described as "read-only memory" because the reprogramming process is generally infrequent, comparatively slow, and often does not permit random access writes to individual memory locations.

For the purposes of the present invention, the term "real time processing" refers to a processing system designed to handle workloads whose state is constantly changing. Real time processing means that a transaction is processed fast enough for the result to come back and be acted on as transaction events are generated. In the context of a database, real time databases are databases that are capable of yielding reliable responses in real time. For the purposes of the present invention, the term "router" refers to a networking device that forwards data packets between networks using headers and forwarding tables to determine the best path to forward the packets. Routers work at the network layer of the TCP/IP model or layer 3 of the OSI model. Routers also provide interconnectivity between like and unlike media devices. A router is connected to at least two networks, commonly two LANs or WANs or a LAN and its ISP's network.

For the purposes of the present invention, the term "server" refers to a system (software and suitable computer hardware) that responds to requests across a computer network to provide, or help to provide, a network service. Servers can be run on a dedicated computer, which is also often referred to as "the server," but many networked computers are capable of hosting servers. In many cases, a computer can provide several services and have several servers running Servers may operate within a client-server architecture and may comprise computer programs running to serve the requests of other programs—the clients. Thus, the server may perform some task on behalf of clients. The clients typically connect to the server through the network but may run on the same computer. In the context of Internet Protocol (IP) networking, a server is a program that operates as a socket listener. Servers often provide essential services across a network, either to private users inside a large organization or to public users via the Internet. Typical computing servers are database server, file server, mail server, print server, web server, gaming server, application server, or some other kind of server. Numerous systems use this client/server networking model including Web sites and email services. An alternative model, peer-to-peer networking may enable all computers to act as either a server or client as needed.

For the purposes of the present invention, the term "solid state sensor" refers to sensor built entirely from a solid-phase material such that the electrons or other charge carriers produced in response to the measured quantity stay entirely with the solid volume of the detector, as opposed to gas-discharge or electro-mechanical sensors. Pure solid-state sensors have no mobile parts and are distinct from electro-mechanical transducers or actuators in which mechanical motion is created proportional to the measured quantity.

For the purposes of the present invention, the term "solid-state electronics" refers to those circuits or devices built entirely from solid materials and in which the electrons, or other charge carriers, are confined entirely within the solid material. The term is often used to contrast with the earlier technologies of vacuum and gas-discharge tube devices and it is also conventional to exclude electro-mechanical devices (relays, switches, hard drives and other devices with moving parts) from the term solid state. While solid-state can include crystalline, polycrystalline and amorphous solids and refer to electrical conductors, insulators and semiconductors, the building material is most often a crystalline semiconductor. Common solid-state devices include transistors, microprocessor chips, and RAM. A specialized type of RAM called flash RAM is used in flash drives and more recently, solid state drives to replace mechanically rotating magnetic disc hard drives. More recently, the integrated circuit (IC), the light-emitting diode (LED), and the liquid-crystal display (LCD) have evolved as further examples of solid-state devices. In a solid-state component, the current is confined to solid elements and compounds engineered specifically to switch and amplify it.

For the purposes of the present invention, the term "time" refers to a component of a measuring system used to sequence events, to compare the durations of events and the intervals between them, and to quantify the motions of objects. Time is considered one of the few fundamental quantities and is used to define quantities such as velocity. An operational definition of time, wherein one says that observing a certain number of repetitions of one or another standard cyclical event (such as the passage of a free-swinging pendulum) constitutes one standard unit such as the second, has a high utility value in the conduct of both advanced experiments and everyday affairs of life. Temporal measurement has occupied scientists and technologists, and was a prime motivation in navigation and astronomy. Periodic events and periodic motion have long served as standards for units of time. Examples include the apparent motion of the sun across the sky, the phases of the moon, the swing of a pendulum, and the beat of a heart. Currently, the international unit of time, the second, is defined in terms of radiation emitted by cesium atoms.

For the purposes of the present invention, the term "timestamp" refers to a sequence of characters, denoting the date and/or time at which a certain event occurred. This data is usually presented in a consistent format, allowing for easy comparison of two different records and tracking progress over time; the practice of recording timestamps in a consistent manner along with the actual data is called timestamping. Timestamps are typically used for logging events, in which case each event in a log is marked with a timestamp. In file systems, timestamp may mean the stored date/time of creation or modification of a file. The International Organization for Standardization (ISO) has defined ISO 8601 which standardizes timestamps.

For the purposes of the present invention, the term "transmission control protocol (TCP)" refers to one of the core protocols of the Internet Protocol Suite. TCP is so central that the entire suite is often referred to as "TCP/IP." Whereas IP handles lower-level transmissions from computer to computer as a message makes its way across the Internet, TCP operates at a higher level, concerned only with the two end systems, for example a Web browser and a Web server. In particular, TCP provides reliable, ordered delivery of a stream of bytes from one program on one computer to another program on another computer. Besides the Web, other common applications of TCP include e-mail and file transfer. Among its management tasks, TCP controls message size, the rate at which messages are exchanged, and network traffic congestion.

For the purposes of the present invention, the term "visual display device" or "visual display apparatus" includes any type of visual display device or apparatus such as a CRT monitor, LCD screen, LEDs, a projected display, a printer for printing out an image such as a picture and/or text, etc. A visual display device may be a part of another device such as a computer monitor, television, projector, telephone, cell phone, smartphone, laptop computer, tablet computer, handheld music and/or video player, personal data assistant (PDA), handheld game player, head mounted display, a heads-up display (HUD), a global positioning system (GPS) receiver, automotive navigation system, dashboard, watch, microwave oven, electronic organ, automatic teller machine (ATM) etc.

For the purposes of the present invention, the term "wearable device" refers to a device that may be mounted, fastened or attached to a user or any part of a user's clothing, or incorporated into items of clothing and accessories which may be worn on the body of a user. In some embodiments, wearable device refers to wearable technology, wearables, fashionable technology, tech togs, fashion electronics, clothing and accessories, such as badges, watches, and jewelry incorporating computer and advanced electronic technologies.

For the purposes of the present invention, the term "web service" refers to the term defined by the W3C as "a software system designed to support interoperable machine-to-machine interaction over a network". Web services are frequently just web APIs that can be accessed over a network, such as the Internet, and executed on a remote system hosting the requested services. The W3C Web service definition encompasses many different systems, but in common usage the term refers to clients and servers that communicate using XML messages that follow the SOAP standard. In such systems, there is often machine-readable description of the operations offered by the service written in the Web Services Description Language (WSDL). The latter is not a requirement of a SOAP endpoint, but it is a prerequisite for automated client-side code generation in many Java and .NET SOAP frameworks. Some industry organizations, such as the WS-I, mandate both SOAP and WSDL in their definition of a Web service. More recently, RESTful Web services have been used to better integrate with HTTP compared to SOAP-based services. They do not require XML messages or WSDL service-API definitions.

For the purposes of the present invention, the term "wide area network (WAN)" refers to a data communications network that covers a relatively broad geographic area (i.e. one city to another and one country to another country) and that often uses transmission facilities provided by common carriers, such as telephone companies. WAN technologies generally function at the lower three layers of the OSI reference model: the physical layer, the data link layer, and the network layer.

For the purposes of the present invention, the term "World Wide Web Consortium (W3C)" refers to the main international standards organization for the World Wide Web (abbreviated WWW or W3). It is arranged as a consortium where member organizations maintain full-time staff for the purpose of working together in the development of standards for the World Wide Web. W3C also engages in education and outreach, develops software and serves as an open forum for discussion about the Web. W3C standards include: CSS, CGI, DOM, GRDDL, HTML, OWL, RDF, SVG, SISR, SOAP, SMIL, SRGS, SSML, VoiceXML, XHTML+Voice, WSDL, XACML. XHTML, XML, XML Events, Xforms, XML Information, Set, XML Schema, Xpath, Xquery and XSLT.

For the purposes of the present invention, the term "ZigBee" refers a specification for a suite of high level communication protocols used to create personal area networks built from small, low-power digital radios. ZigBee is based on an IEEE 802 standard. Though low-powered, ZigBee devices often transmit data over longer distances by passing data through intermediate devices to reach more distant ones, creating a mesh network; i.e., a network with no centralized control or high-power transmitter/receiver able to reach all of the networked devices. The decentralized nature of such wireless ad-hoc networks make them suitable for applications where a central node can't be relied upon. ZigBee may be used in applications that require a low data rate, long battery life, and secure networking. ZigBee has a defined rate of 250 kbit/s, best suited for periodic or intermittent data or a single signal transmission from a sensor or input device. Applications include wireless light switches, electrical meters with in-home-displays, traffic management systems, and other consumer and industrial equipment that requires short-range wireless transfer of data at relatively low rates. The technology defined by the ZigBee specification is intended to be simpler and less expensive than other WPANs, such as Bluetooth® or Wi-Fi. Zigbee networks are secured by 128 bit encryption keys.

Description

While the invention is susceptible to various modifications and alternative forms, specific embodiment thereof has been shown by way of example in the drawings and will be described in detail below. It should be understood, however that it is not intended to limit the invention to the particular forms disclosed, but on the contrary, the invention is to cover all modifications, equivalents, and alternatives falling within the spirit and the scope of the invention.

Figure 3:
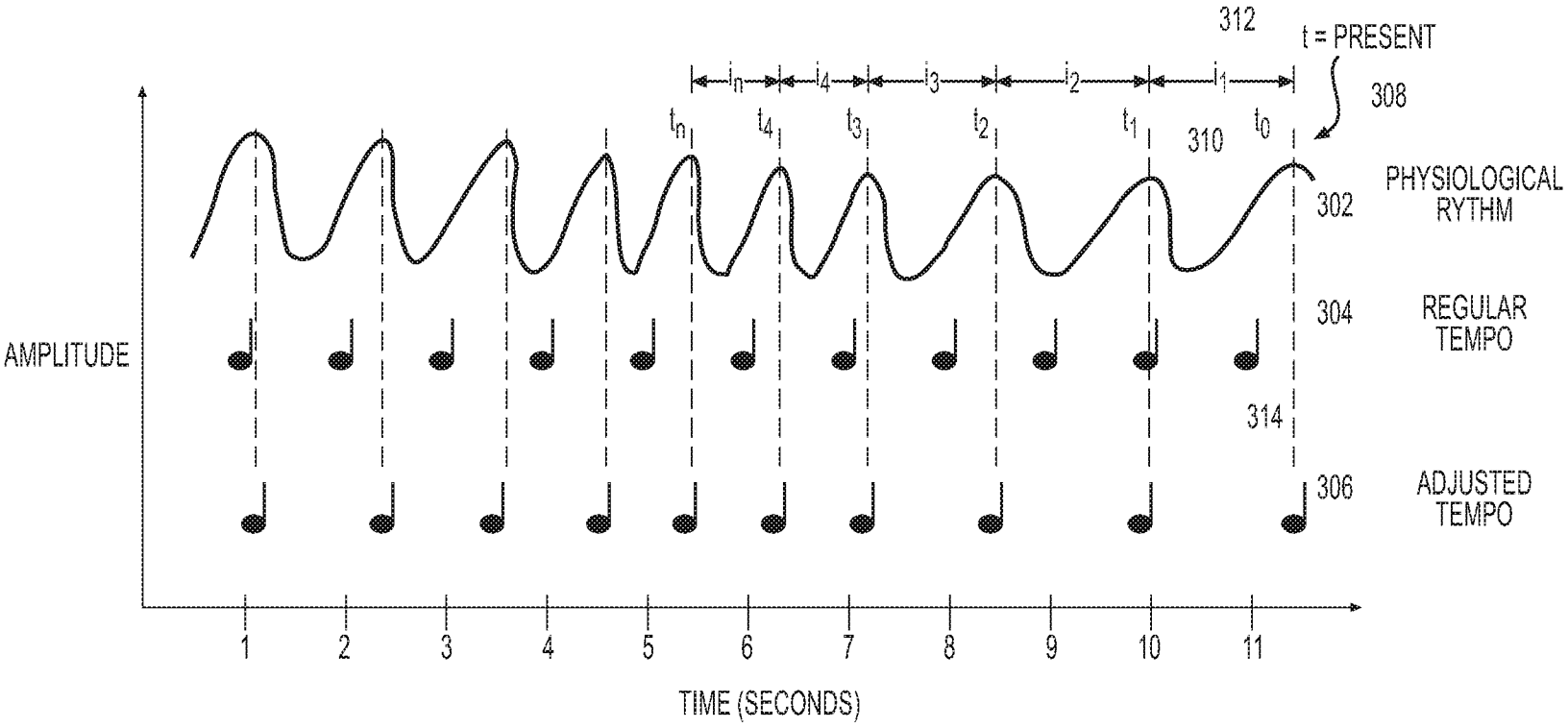
FIG. 3 is a diagram showing physiological rhythm plotted on the same timescale as two musical rhythms, one with a regular tempo and one with a physiologically modulated tempo.

FIG. 1 is a flowchart showing the major components of the physiological metronome. Production component 102 is a component that produces a physiological waveform from a user or group of users. Examples of physiological rhythms that can be used to generate a physiological waveform can be cardiovascular or electrical, and include heartbeat, breathing, blood constituent concentrations, hormonal concentrations, and brainwaves. Devices for measuring these rhythms are shown in detail in FIGS. 4, 5, 6, 7 and 8 and are described below. Transmission component 104 is a component that transmits the physiological waveform(s) to a tempo generator in real time. The real time transmission of data can be wireless or by electrical connections in an integrated device. Modification component 106 is a component that modifies the physiological waveform(s). In the case of multiple users, the waveforms from each user can be integrated into one waveform by mathematical processes on the amplitude versus time data, such as addition, multiplication, division, as well as combinations of those and other functions. Once a single waveform has been established, local minima and maxima and the time elapsed between them can be determined. Analysis of the most recent waveform data (e.g. last n heartbeats) can be used to generate a waveform that is predictive of the future physiological rhythms. The waveform can then be slightly sped up, slowed down, or phase shifted. More details on the modification of physiological waveform(s) are shown in FIG. 3.

Tempo generator 108 modulates tempo based on the physiological waveform(s). The output of this step is equivalent to that of a musical metronome, with the difference being that the tempo of the metronome changes as a function of changes in the user(s) physiological rhythm(s). For example, if the physiological rhythm is one users heartbeat, when the heartbeat speeds up the metronome can also speed up, or when the heartbeat slows down the metronome can also slow down. Various musical rhythms based on the modulated tempo can be employed, including sending a signal at each quarter note with or without accents to distinguish the down beat or first beat of a measure, subdivisions including eighth notes, sixteenth notes, etc., triplets, dotted notes, and other standard electronic metronome features. Phase shifting of the tempo and changes in the real time frequency can be implemented in tempo generator 108 as well as in modification component 106. Tempo generator 110 has the same properties a tempo generator 108, except that the tempo is modulated based on a modified physiological waveform.

Music generator 112 produces music using the tempo modulated by the user's physiological rhythm in real time. The music can be produced by a performer who receives rhythmic information from the tempo generator (illustrated in FIG. 10), or by a music producing machine that uses the input from the tempo generator to modulate the tempo of the music. Feedback component 114 is a component that allows the music generated by music generator 112 to be heard by the user in real time, or the tempo generated in tempo generator 108 or tempo generator 110 to be monitored by a user.

Figure 2:
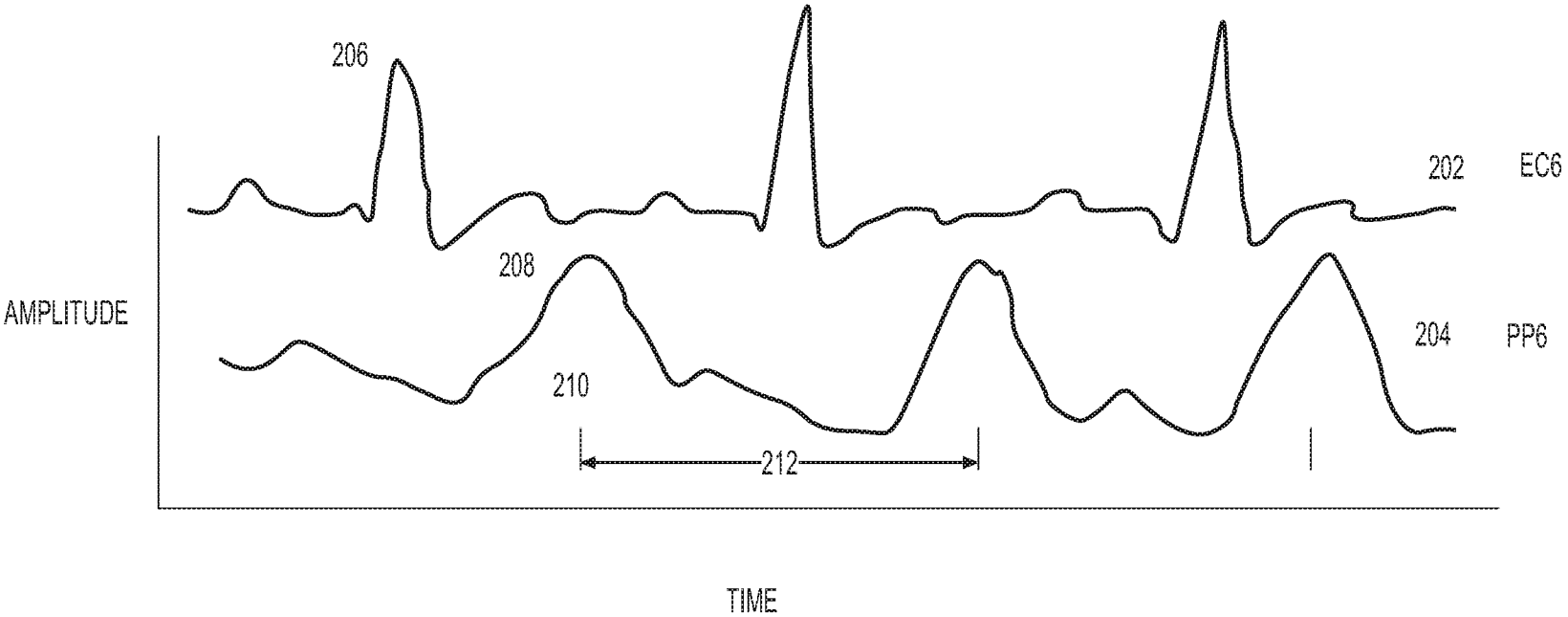
FIG. 2 is a graph showing possible physiological waveforms according to one embodiment of the present invention.

FIG. 2 is an example of possible physiological waveforms. FIG. 2 shows an electrocardiogram (ECG) waveform 202 and a photoplethysmography (PPG) waveform 204 plotted on the same times sales. Peak 206 in ECG waveform 202 that indicates a heartbeat. Peak 208 in PPG waveform 204 is plotted on the same timescale as the ECG data. The PPG data is phase shifted from the ECG data. Time 210 is a time where the PPG data is at a maximum, Time 212 indicates the time elapsed between two consecutive PPG maxima. Variations in time 212 for the various physiological waveforms are what are used to modulate the musical tempos.

FIG. 3 shows a physiological rhythm plotted on the same timescale as two musical rhythms, one with a regular tempo and one with a physiologically modulated tempo. In FIG. 3, physiological amplitudes 302 are shown with the peaks highlighted in time by dotted lines. FIG. 3 shows a regular musical tempo 304 as produced by a typical metronome, with the time between beats being equal. FIG. 3 shows an example of a musical rhythm, i.e., musical rhythm 306 that has been adjusted to be synchronous with the physiological rhythm. The musical rhythm could also be adjusted to be asynchronous, phase shifted from the physiological rhythm, or at different frequencies that change proportionally to changes in the physiological frequencies. Arrow 308 marks where the present would be in a real time recording. Times 310 indicate times at which the last maximum in the physiological rhythms was measured (T0), the maximum before that (T1), and so on for past events. Time interval 312 shows the time interval between the last two maxima (i1), the interval before that (i2), and so on. Changes in the intervals measured in the physiological rhythm are used by the tempo generator to control the tempo of the music.

Figure 4:
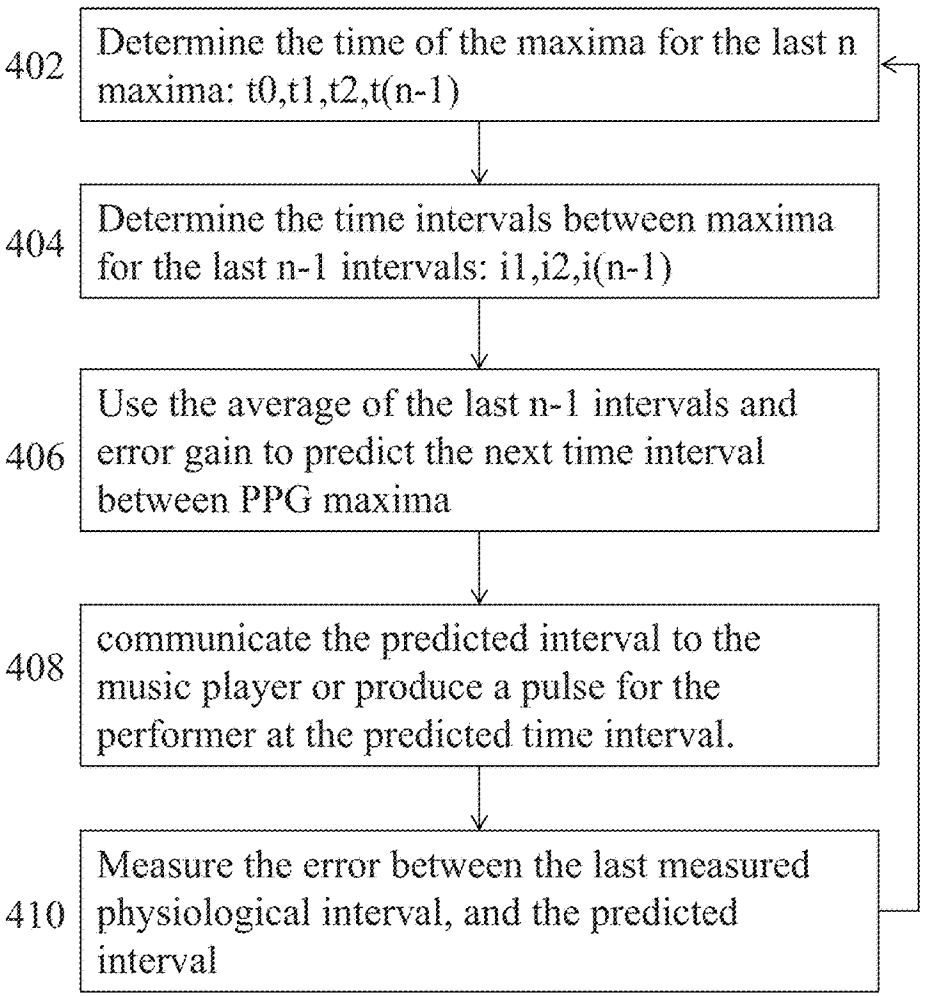
FIG. 4 a flowchart showing an example of how a rhythm generator synchronizes quarter notes with a heartbeat measured by PPG and communicates the modulated tempo to a music player according to one embodiment of the present invention.

FIG. 4 illustrates an example of one embodiment of the present invention where the rhythm generator synchronizes quarter notes with a heartbeat measured by PPG and communicates the modulated tempo to a music player. In 402 the time of the maxima for the last n maxima in the PPG waveform are recorded in electronic memory: t0, t1, t2, t(n−1). In step 404 the time intervals between PPG maxima for the last n−1 intervals is determined by subtraction i1=t0−t1, i2=t1−t2, i3=t2−t3, and so on. In step 406, the average of the last n−1 intervals is taken and used together with the error (obtained in step 410 of past cycles) and error gain (set in the device as a factor to be multiplied with the error before adding the error to the next prediction) to predict the next time interval between PPG maxima. In step 408 the predicted interval is communicated to the music player, or a pulse is produced for the performer at the predicted time interval. In step 410, the error between the last measured physiological interval and the predicted interval is measured. As this process is a cycle, the user will have the option to phase shift the generated tempo relative to the PPG. For instance, since the time of the heartbeat is phase shifted relative to the PPG maximum, this will allow the user to synchronize the tempo generator with the heartbeat, for instance by measuring their pulse with their finger on their neck or wrist or using another heart monitoring system while phase shifting the tempo generated by the tempo generator. The error between the last measured physiological interval and the predicted interval is used as indication of speeding or slowing heartrate and that error can be used to correct for the next interval. An error gain can be set by the user as a percentage to be multiplied by the error before it is incorporated into the predicted time interval. For instance, a gain of 0% would mean that the error is ignored, a gain of 100% would mean the error is added to the next predicted beat, or a gain of 200% would mean that the error value is doubled before adding it to the next predicted time interval. In one embodiment, n (the number PPG maxima) is set at a value (e.g. 6) in the device. In another embodiment, n can be varied by the user from 1-60 to obtain the desired sensitivity in the feedback system. The error number used for time interval prediction can also be an average of previous errors, e.g. from one up to n previous errors.

Figure 5:
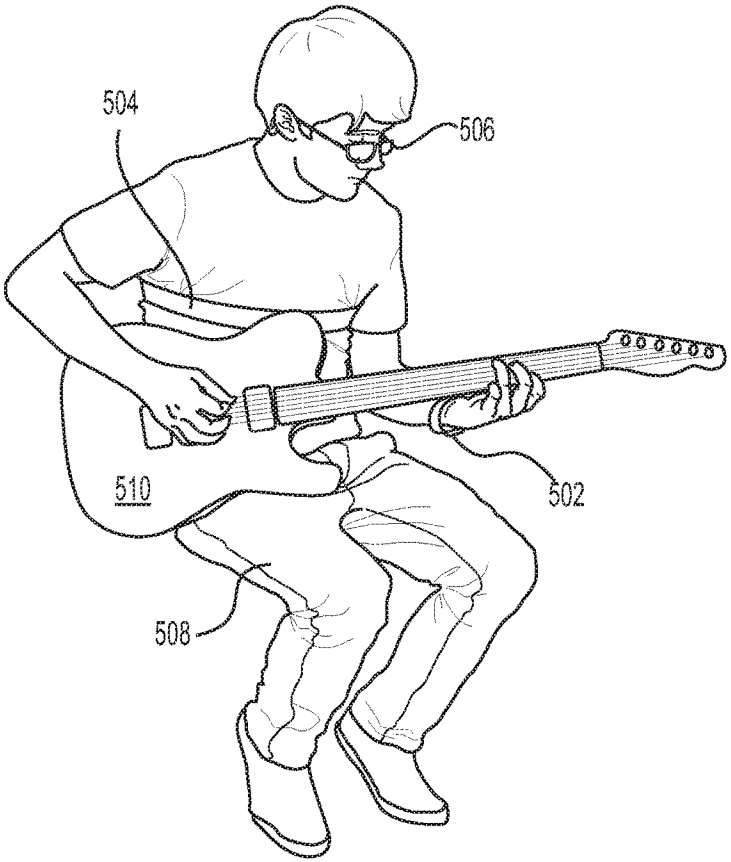
FIG. 5 is a drawing of various components used to measure the physiological rhythm from a user as well as to feedback the generated tempo to a performer without interfering with the music according to one embodiment of the present invention.

FIG. 5 is a drawing of various components used to measure the physiological rhythm from a user as well as to feedback the generated tempo to a performer without interfering with the music according to one embodiment of the present invention. FIG. 5 shows a wristband 502 that may be used for obtaining PPG waveforms and for delivering tactile indicators of tempo. FIG. 5 also shows a chest band 504 that can be used to measure ECG, and breathing rates, as well as deliver tactile indicators of tempo. FIG. 5 also shows glasses 506 that can be used to deliver optical indicators of tempo and/or obtain physiological rhythms Arrow 508 indicates adhesive or implantable devices that can be used to measure physiological rhythms and/or deliver indicators of tempo.

Figure 6:
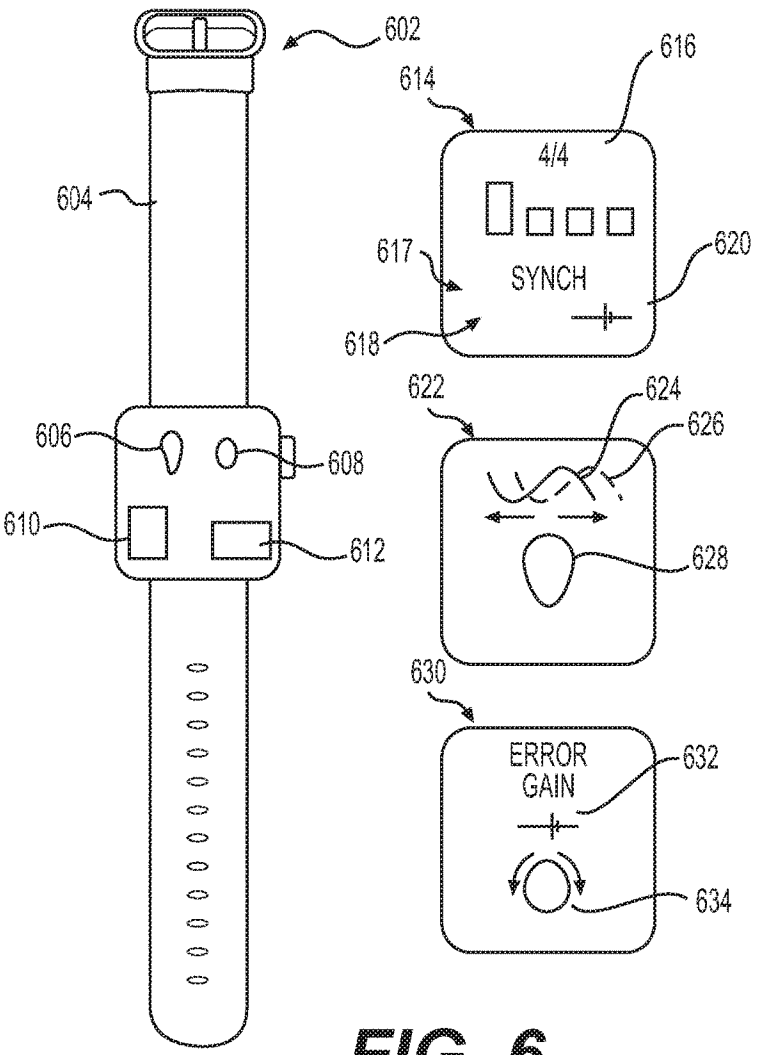
FIG. 6 is a drawing of a wristband device and three display modes according to one embodiment of the present invention.

FIG. 6 is a drawing of a wristband device 602 according to one embodiment of the present invention. In FIG. 6, wristband device 602 is shown from the side that contacts the user's wrist. Band 604 connects the device to the skin. The band could be integrated into clothing, and could also attach the device to a wrist, ankle, waist, neck or head. Also shown in FIG. 6 is a light source 606 for photoplethysmography, a sensor 608 for photoplethysmograhy, and a processor 610 that contains the waveform processor, tempo generator, and controls for the display. A wireless transmitter or adapter can also be included for data transmission to other devices. A tactile tempo communicator 612 can send a tactile pulse to the user's skin by vibrating. Tactile tempo communicator 612 can be driven by an electron actuator such as a piezoelectric device. A display is shown in three different modes, i.e., mode 614, mode 622, and mode 630, on the other side of wristband device 602, i.e., the side of wristband device 602 that visible to the user. A visual metronome display 616 shows the tempo that is being synchronized to the photoplethysmography waveform. In this case the tempo is 4/4, and typical metronome settings can be applied. Indicators and controls shown generally at arrow 618 indicate synchronization settings and can be used to control synchronization settings, respectively. For instance, the device can be set so that the played interval is faster or slower than a physiological waveform 620 shows the error gain setting and control. The gain can be adjusted with this setting. Mode 622 allows adjustments and visualization of the phase of the musical rhythm relative to the physiological rhythm. FIG. 6 also shows a physiological waveform 624 and a phase shifted tempo 626 being produced by the device. A control dial 628 allows shifting of the phase of the tempo being produced by the device relative to the physiological rhythm. Mode 630 allows control of the error gain. Indicator 632 is an indicator of the measured error for the last n maxima. Dial 634 is a dial that allows the user to increase or decrease the gain.

Figure 7:
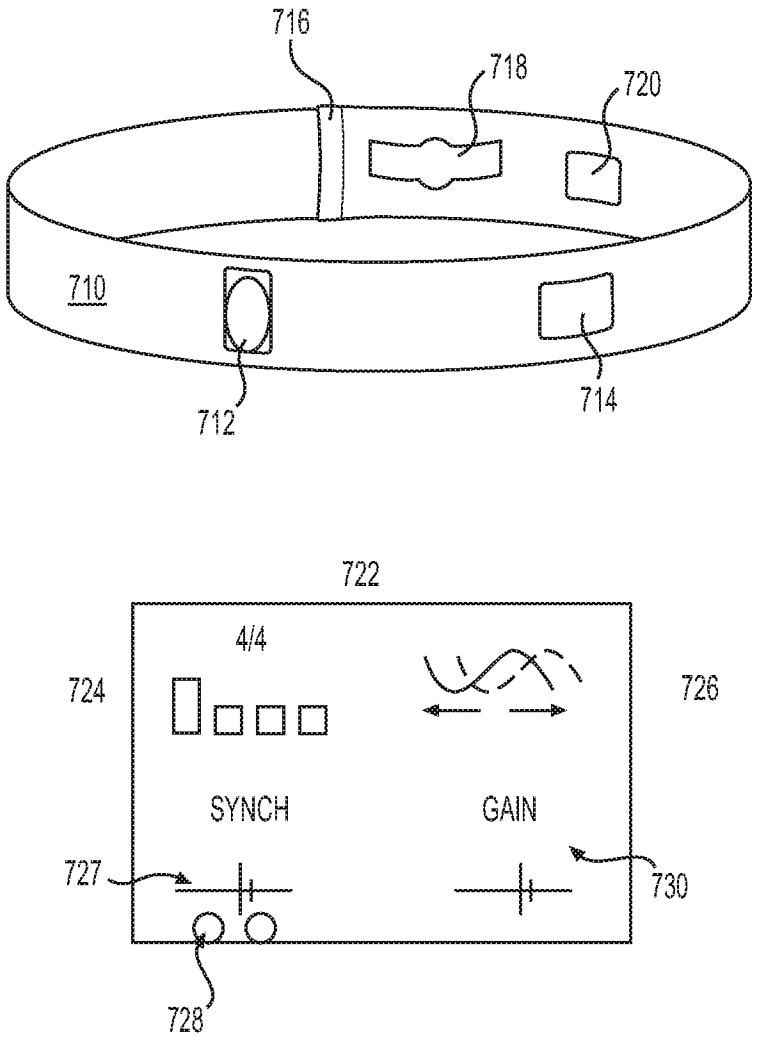
FIG. 7 is a drawing of a headband device, a chest band device and a display screen according to one embodiment of the present invention.
Figure 7:
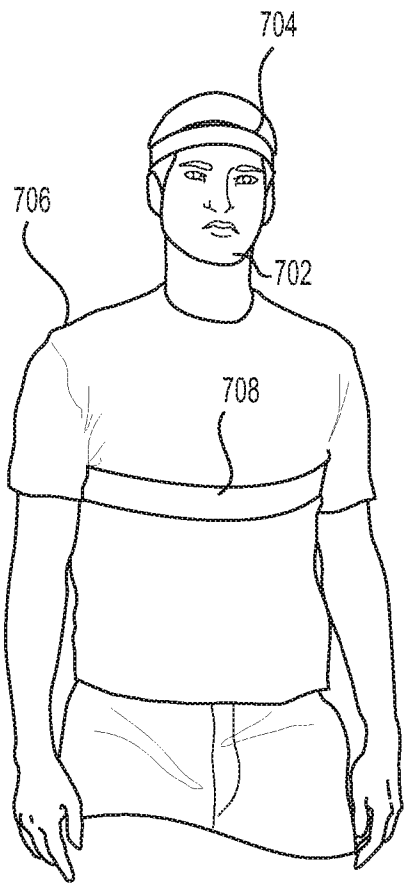

FIG. 7 is a drawing of a headband and a chest band device according to one embodiment of the present invention worn by a user 702. Headband device 704 is compatible with electroencephalography (EEG). Chest band device 708 is suitable for measuring breathing waveforms and compatible with electrocardiography (EKG). FIG. 7 also shows a band device 710 that may be a headband or chest band. Band device 710 includes electrodes 712 and 714 for EKG or EEG. Multiple electrodes can be placed through band device 710. A tensiometer 716 can measure breathing waveforms by detecting tension in the band created by chest expansion and contraction upon breathing. An electronic data processor 718 can either contain the components shown in FIG. 1, or can transmit the waveform data to an external device and receive tempo information from an external device. A tactile rhythm communicator 720 can transmit rhythmic pulses to the skin of the user by an electronic actuator. A display screen 722 allows the user to visualize the rhythmic information provided by the tempo generator and to tune the parameters that control it. A visual metronome display 724 shows the tempo that is being synchronized to the photoplethysmography waveform. In this case the tempo is 4/4, and typical metronome settings can be applied. A phase shift display and controller 726 that allows the user to control the phase shift between the physiological rhythm and the musical tempo. Indicators 727 show synchronization settings. Buttons 728 control synchronization settings. For instance, band device 710 can be set so that the played interval is faster or slower than the physiological waveform. Arrow 730 generally shows visualization and control of the error gain, indicating the measured error for the last n maxima and allowing the user to increase or decrease the gain.

Figure 8:
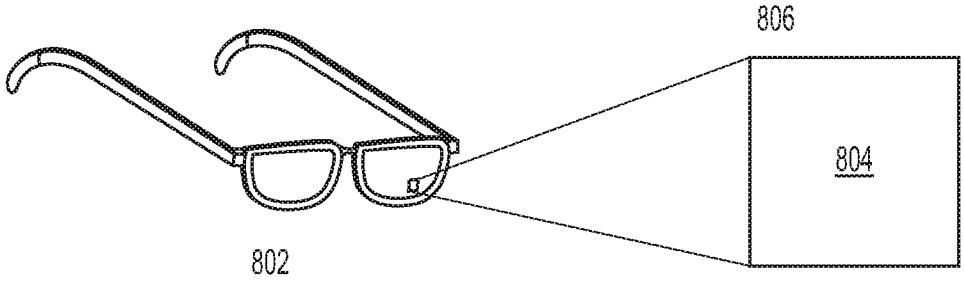
FIG. 8 is a drawing of glasses that can be used to provide optical feedback according to one embodiment of the present invention and an enlarged view of a small section of a lens of the glasses.

FIG. 8 is a drawing of glasses 802 that can be used to provide optical feedback according to one embodiment of the present invention. Glasses 802 contain a small display that can indicate the rhythmic and tempo information to a performer. View 804 is an enlarged view of a small section of a lens of glasses 802. Optical flashes 806 of this small section of the glasses signal the musical tempo to a user wearing the glasses.

Figure 9:
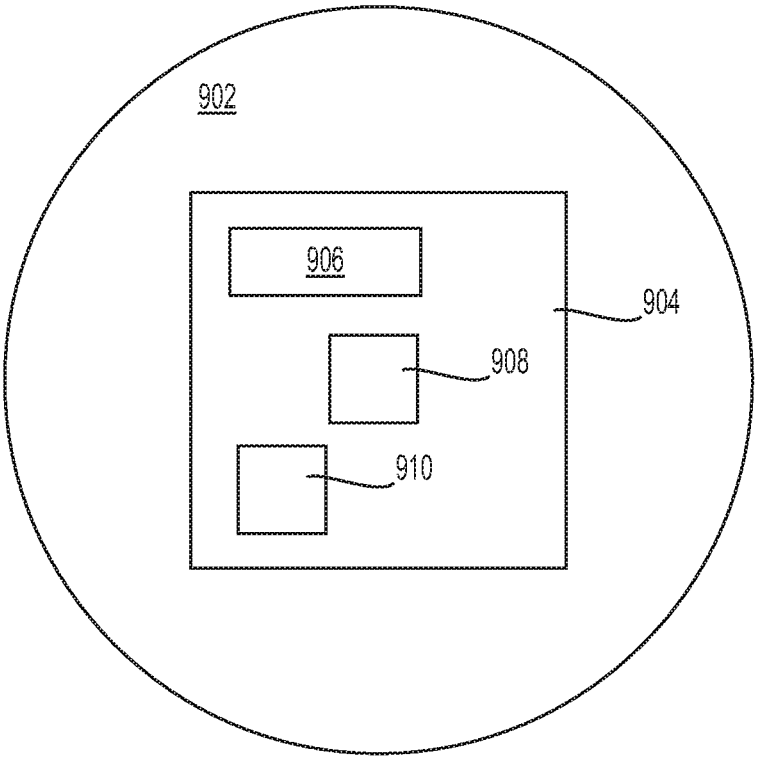
FIG. 9 is a drawing of an adhesive patch device that can be integrated into clothing or implanted into tissue according to one embodiment of the present invention.

FIG. 9 shows an adhesive patch 902 according to one embodiment of the invention and shows how a device of the present invention can be integrated into clothing or implanted into tissue. Adhesive patch 902 can monitor physiological rhythms and/or deliver rhythmic and/or tempo information to the user. Adhesive patch 902 may be attached to the skin of a user, may be a coating for integration into fabric, or may be biocompatible coating for implantation into tissue. Container 904 contains various components various components of adhesive patch 902. Sensor 906 is a sensor capable of measuring a physiological rhythm. Tactile rhythm communicator 908 is a tactile rhythm communicator that can send real time tempo information to the user in the form of tactile pulses. Electronic data processor 910 is an electronic data processor that can either contain the components shown in FIG. 1, or transmit the waveform data to an external device and receive tempo information in real time.

Figure 10:
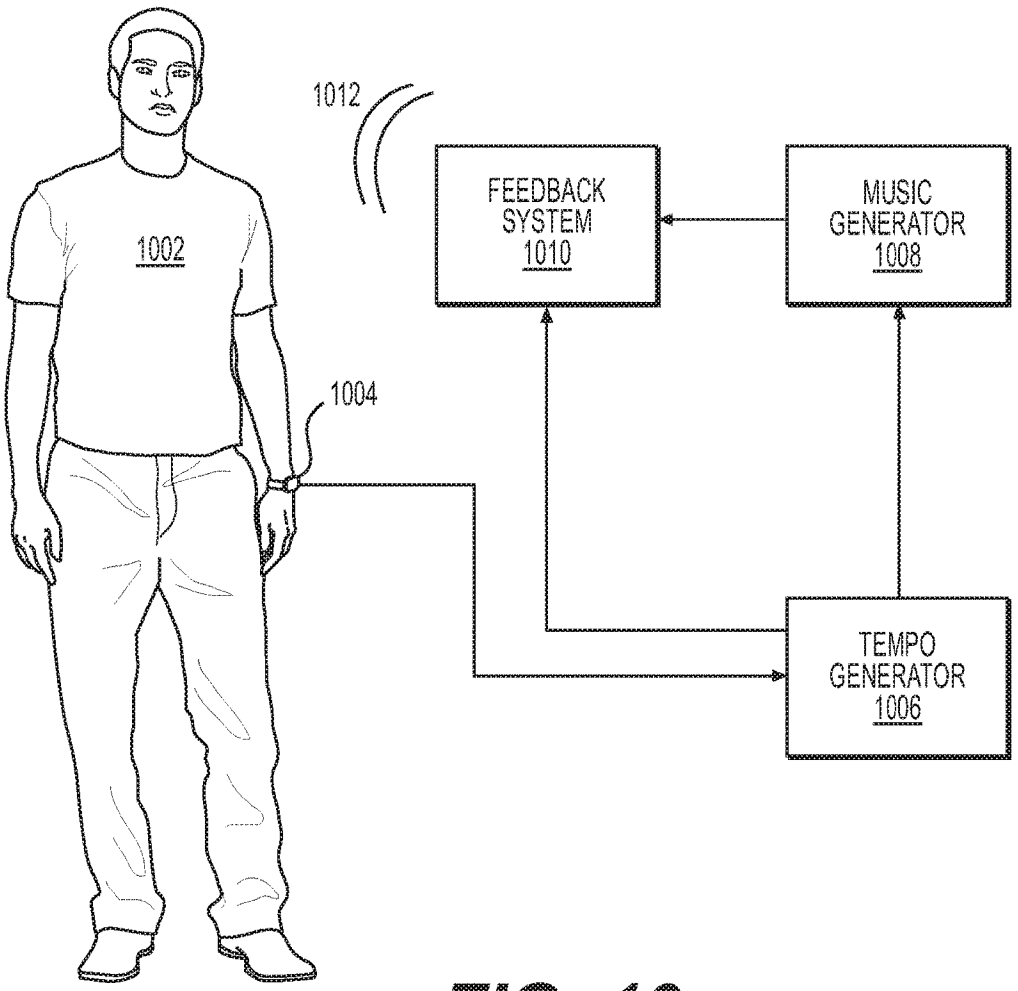
FIG. 10 is a drawing of the invention being used by a listener to control the tempo of music produced by a music generator according to one embodiment of the present invention.

FIG. 10 shows a system according to one embodiment of the present invention being used by a listener to control the tempo of music produced by a music generator. FIG. 10 shows a user 1002 and a physiological waveform measurer 1004 that may be any device used to measure a physiological waveform, such as a wristband. FIG. 10 also shows a tempo generator 1006 and a music generator 1008, which could be a digital music playing device. The music itself could be of any genre. Feedback system 1010 is a feedback system that communicates the music with modulated tempo to the user, for instance by means of speakers or headphones. Feedback signal 1012 is a feedback signal in the form of sound. The feedback could also be in the form of visual information, tactile information, or for medical applications the delivery of therapeutic agents or treatments at frequencies modulated by physiological rhythms.

Figure 11:
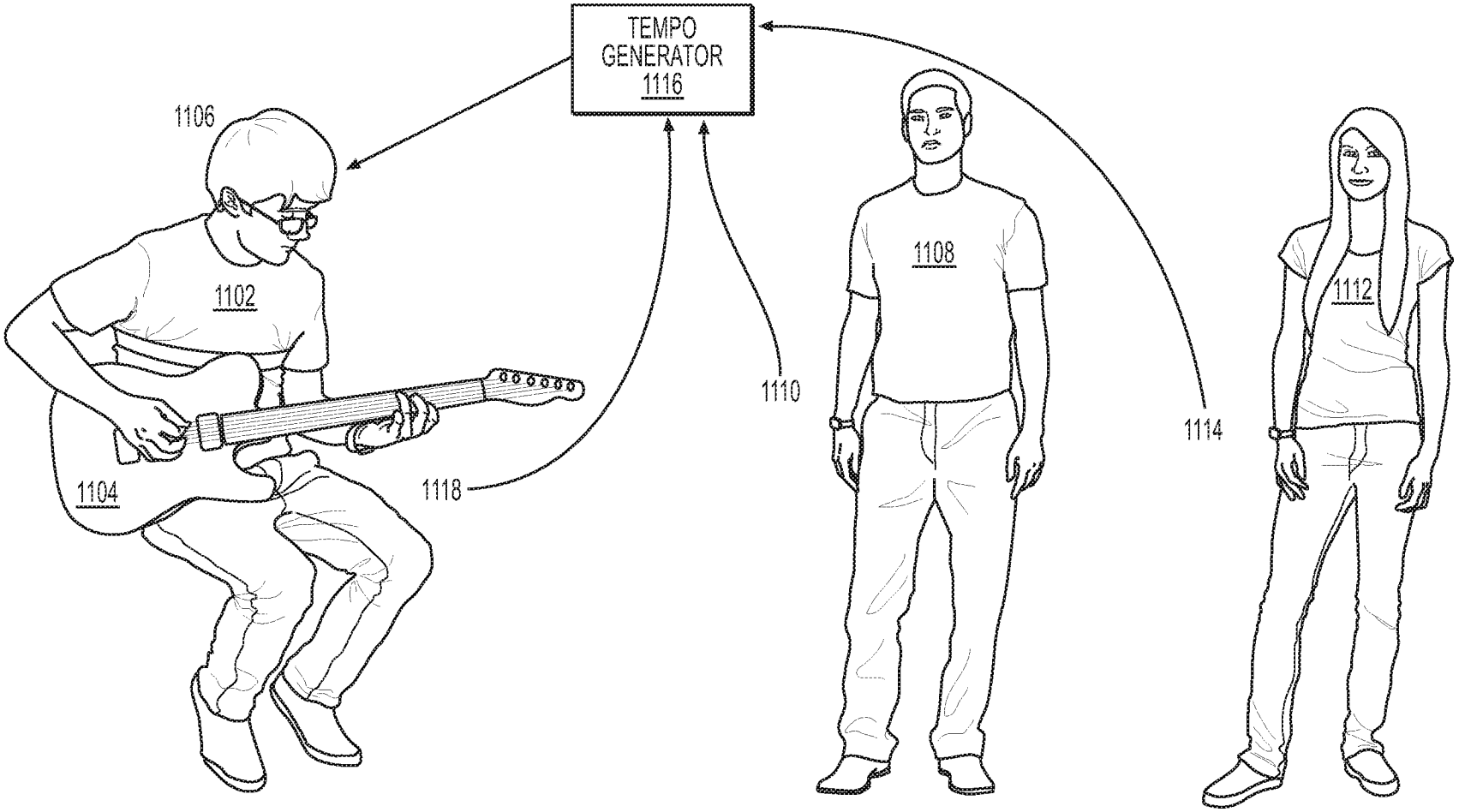
FIG. 11 is a drawing of tempo generator being used for a musical performance according to one embodiment of the present invention.

FIG. 11 shows a system according to one embodiment of the present invention being used for a musical performance. FIG. 11 shows a performer 1102 and musical instrument 1104 is a musical instrument. Component 1106 is any of the components used to communicate the modulated tempo information to the performer in real time, in this case drawn as an optical system. Listener 1108 is a listener to the performance, and physiological waveform generator 1110 is a physiological waveform generator used by listener 1108. Listener 1112 is a second listener and physiological waveform generator 1114 is a second physiological waveform generator used by listener 1112. One or multiple users can simultaneously provide waveforms to a tempo generator 1116, which sends the physiological waveform modulated tempo information to the performer in real time. Physiological waveform generator 1118 is a physiological waveform generator used by performer 1102. This can also be used to modulate tempos, with or without combinations with the listeners' physiological waveforms.

Figure 12:
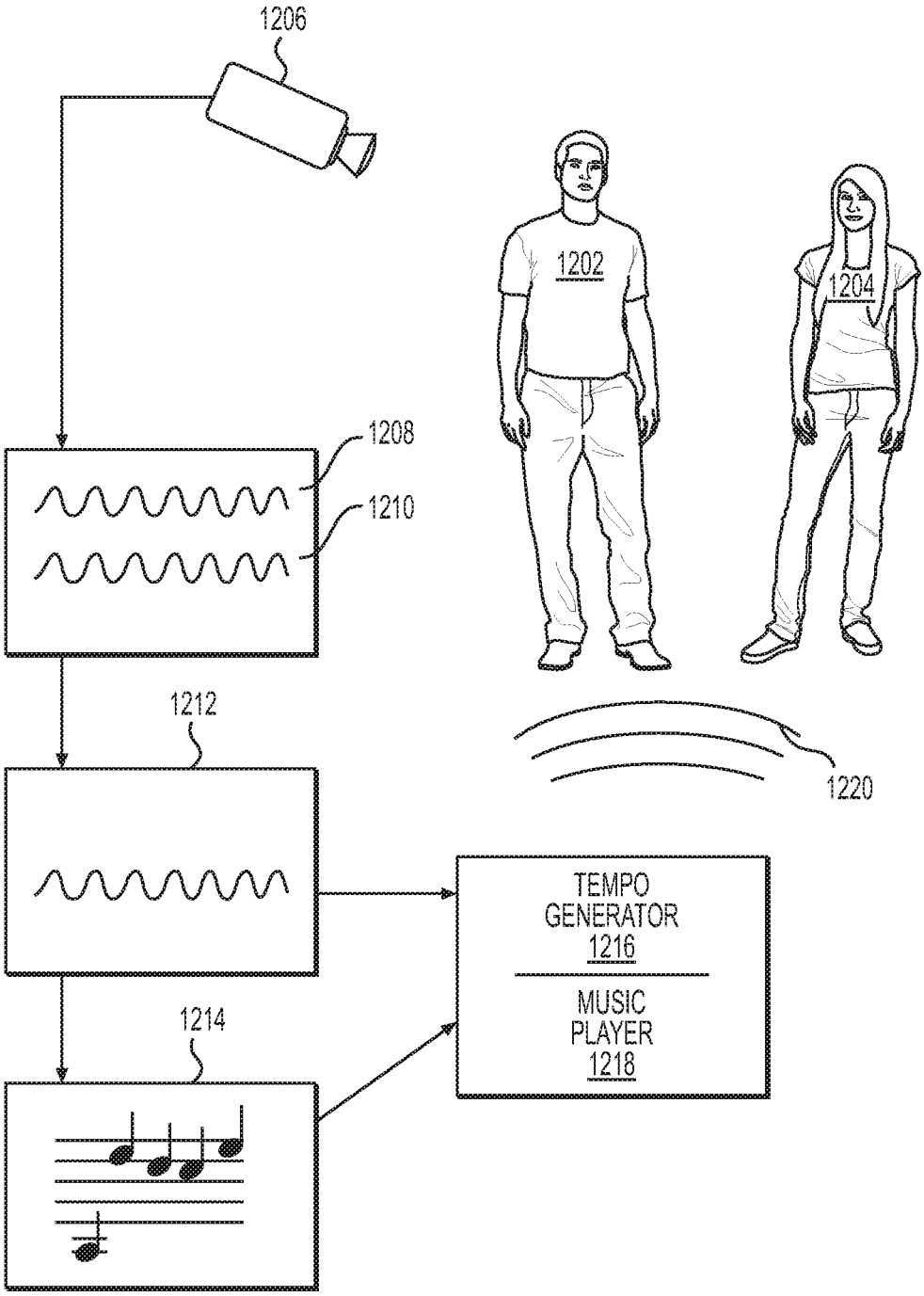
FIG. 12 is a drawing of two users listening to music being controlled by their collective physiological rhythms according to one embodiment of the present invention.

FIG. 12 shows an embodiment of the present invention where two users, i.e., two listeners, are listening to music being controlled by their collective physiological rhythms FIG. 12 shows listener 1202 and listener 1204. Infrared camera 1206 is an infrared camera capable of measuring skin absorption changes in a way suitable for generation of a PPG waveform. PPG waveform 1208 and PPG waveform 1210 are the PPG waveforms of listener 1202 and 1204, respectively. Combined waveform 1212 is the combined waveforms of listener 1202 and listener 1204. A single listener can also be used to produce a single waveform. 1214 that shows a sequence of musical notes to be played at a defined tempo. This could be in the form of an electronic file such as MIDI or any recording device that contains information about a sequence of acoustic tones to be made at various times. Tempo generator 1216 is a tempo generator that generates a tempo based on the physiological waveform. Music player 1218 is a music player that plays the music at the tempo produced by tempo generator 1216. Music 1220 is music produced by the music player and tempo generator, and heard by the users in real time.

Figure 13:
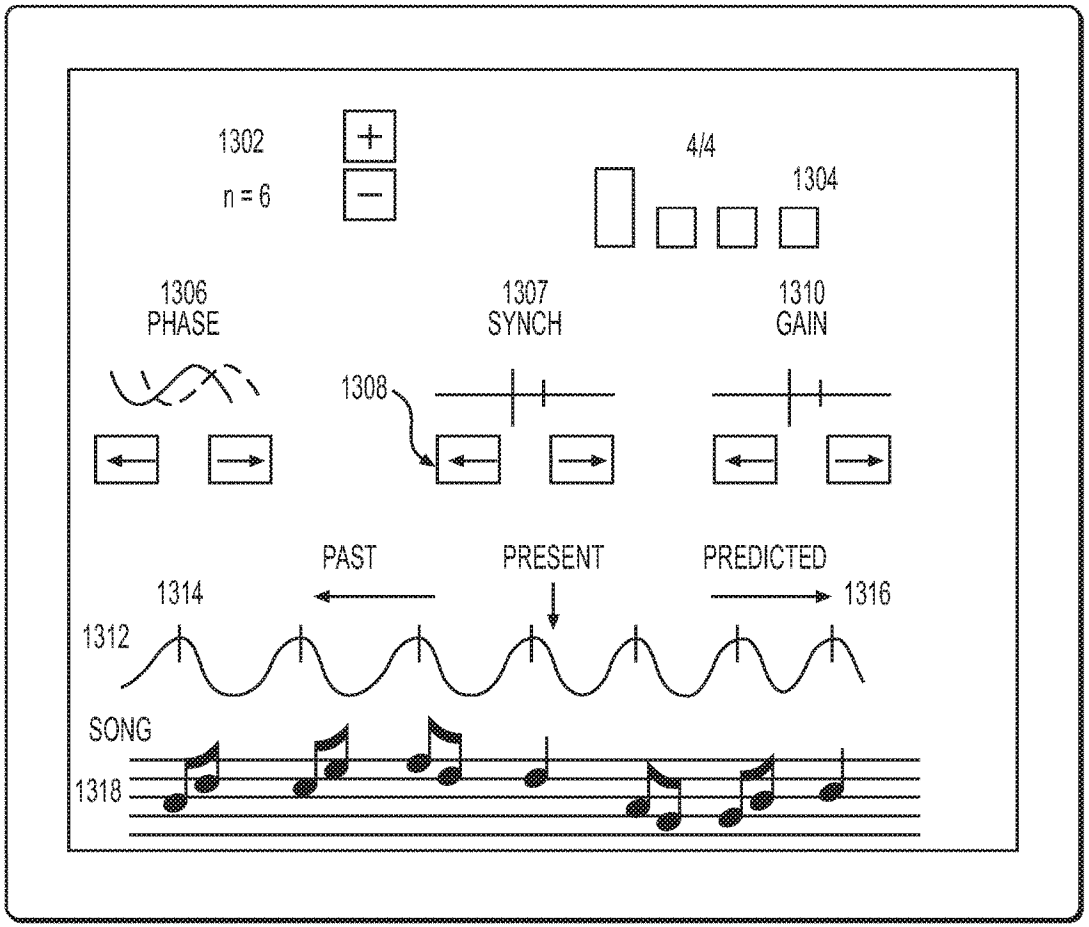
FIG. 13 is a drawing of a display screen that allows a user to interact with and control the device according to one embodiment of the present invention.

FIG. 13 shows a display screen of a device according to one embodiment of the present invention that allows a user to interact with and control the device according to one embodiment of the present invention. Control 1302 is a control of n, the number of waveform maxima used in predicting the interval of the next maxima for tempo generation. Buttons can be used to increase or decrease n. Visual metronome display 1304 is a visual metronome display that shows the tempo that is being synchronized to the physiological waveform. In this case the tempo is 4/4, and typical metronome settings can be applied. Phase shift display 1306 is a phase shift display and controller that allows the user to control the phase shift between the physiological rhythm and the musical tempo. Indicators 1307 indicate synchronization settings. Buttons 1308 can be used to control synchronization settings. For instance, the device can be set so that the played interval is faster or slower than the physiological waveform. Visualization and control of the error gain 1310 shows visualization and control of the error gain, indicating the measured error for the last n maxima and allowing the user to increase or decrease the gain. Real time display 1312 is a real time display of the measured physiological waveform up until the present, as well as the predicted waveform based on the past measurements. Highlighted maxima 1314 are maxima highlighted in the waveform, the distances between which determine the time intervals. In addition to the maxima, other distinguishing features in the waveform data can also be used for predicting the next interval, including minima, inflection points, and sharp changes in slope. Predicted waveform 1316 is predicted waveform. Song 1318 is a song being played, synchronized with the physiological waveform.

Figure 14:
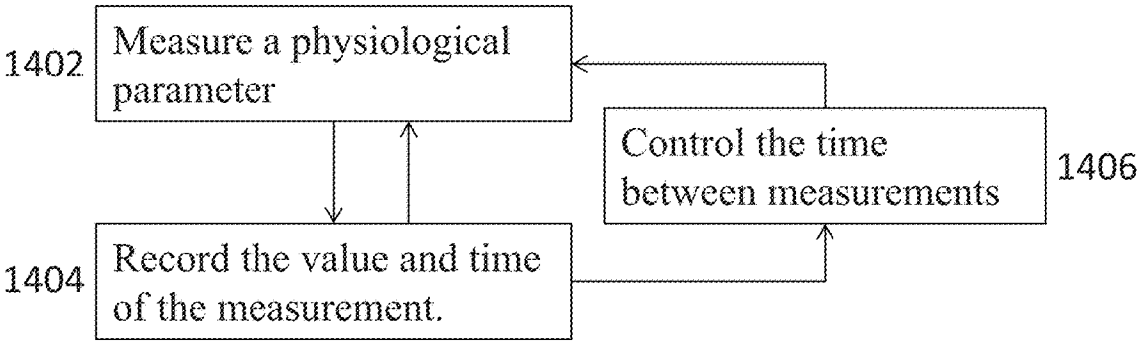
FIG. 14 is a flowchart illustrating a procedure for producing one or more physiological waveforms from a user or a group of users according to one embodiment of the present invention.

FIG. 14 shows an elaboration on component 102, which produces a physiological waveform from a user or group of users according to one embodiment of the present invention. Measurement 1402 is the measurement of a physiological parameter, such as optical absorption by PPG or voltages measured by ECG or EKG. Recording 1404 is the recording of the value and time of the measurement. The data can be stored in an array with each measured physiological value being associated with the time at which it was measured. The time can be obtained from an internal clock within the device. Controlling time step 1406 involves controlling the time between measurements. A higher frequency of measurements will be required for higher frequency feedback.

Figure 15:
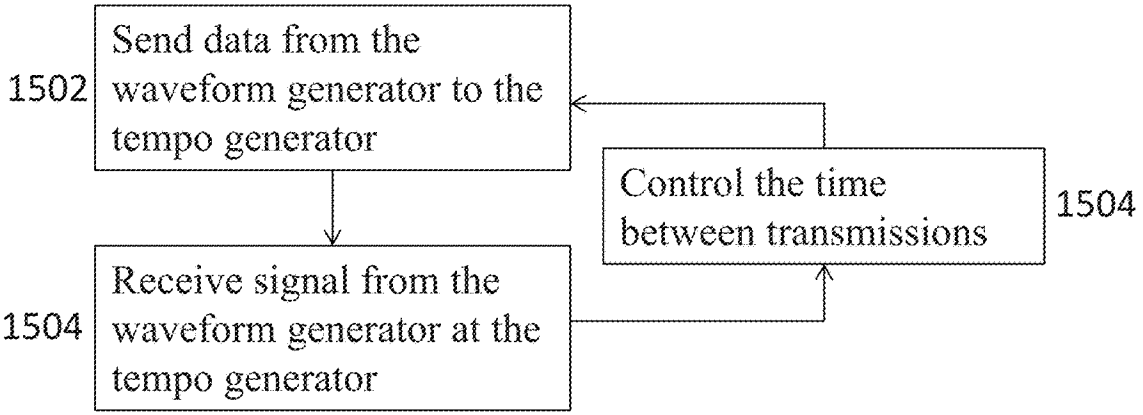
FIG. 15 is a flowchart illustrating the transmission of one or more physiological waveforms to a temper generator in real time according to one embodiment of the present invention.

FIG. 15 shows an elaboration on transmission component 104, which transmits the physiological waveform(s) to a tempo generator in real time. At send data/signal step 1502 data or a signal from the waveform generator is sent to the tempo generator. This data can consist of the value measured and the time at which it was measured. If the time between recordings are made at known intervals, and the transmission time is known then the order of the sending of the signal can be used to mark time. At receive signal/data step 1504 the data or signal is received from the waveform generator at the tempo generator. If the order or time data is received is important for synchronizing the tempo with the physiological waveform, it can be recorded. Controlling time step 1406 controls the time between transmissions, which can be used as a clock to mark time between data points in the waveforms.

Figure 16:
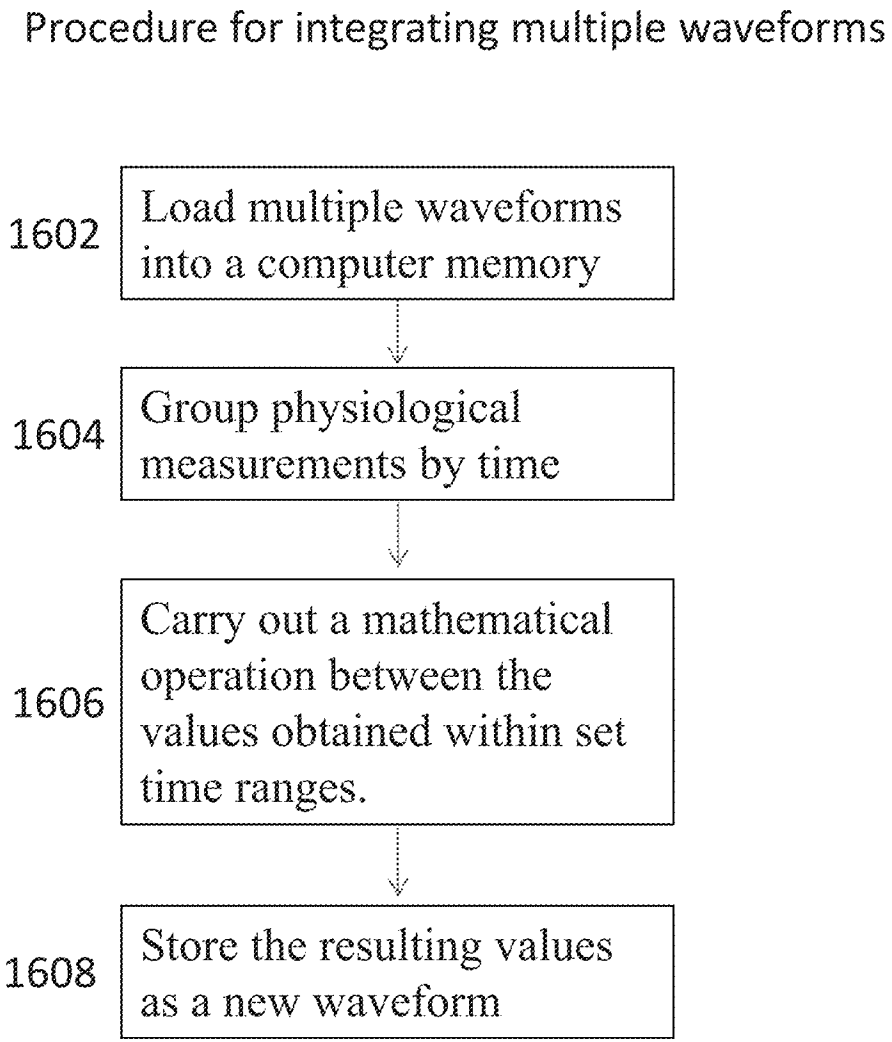
FIG. 16 is a flowchart illustrating a procedure for integrating multiple waveforms from multiple users into a single waveform according to one embodiment of the present invention.

FIG. 16 shows a procedure for integrating multiple waveforms from multiple users into a single waveform according to one embodiment of the present invention. At load step 1602 multiple waveforms are loaded into a computer memory. At grouping step physiological measurements are grouped by time. The multiple waveforms can be loaded into the memory of a processor in a two dimensional array form, where the first dimension is time or order received and the second dimension is the user number. An operation step 1606 a mathematical operation is carried out between the values obtained within set time ranges. Carrying out mathematical operations on the columns of the array, i.e. the physiological values measured within a selected timeframe, is one way to generate a single waveform from multiple waveforms. Examples of mathematical operations are addition, subtraction, multiplication, division, and various combinations of those functions. Each waveform can also be normalized or weighted, to give certain users more or less influence on the collective waveform, or to compensate for error in measurements. At storing step 1608 the resulting values are stored as a new waveform.

Figure 17:
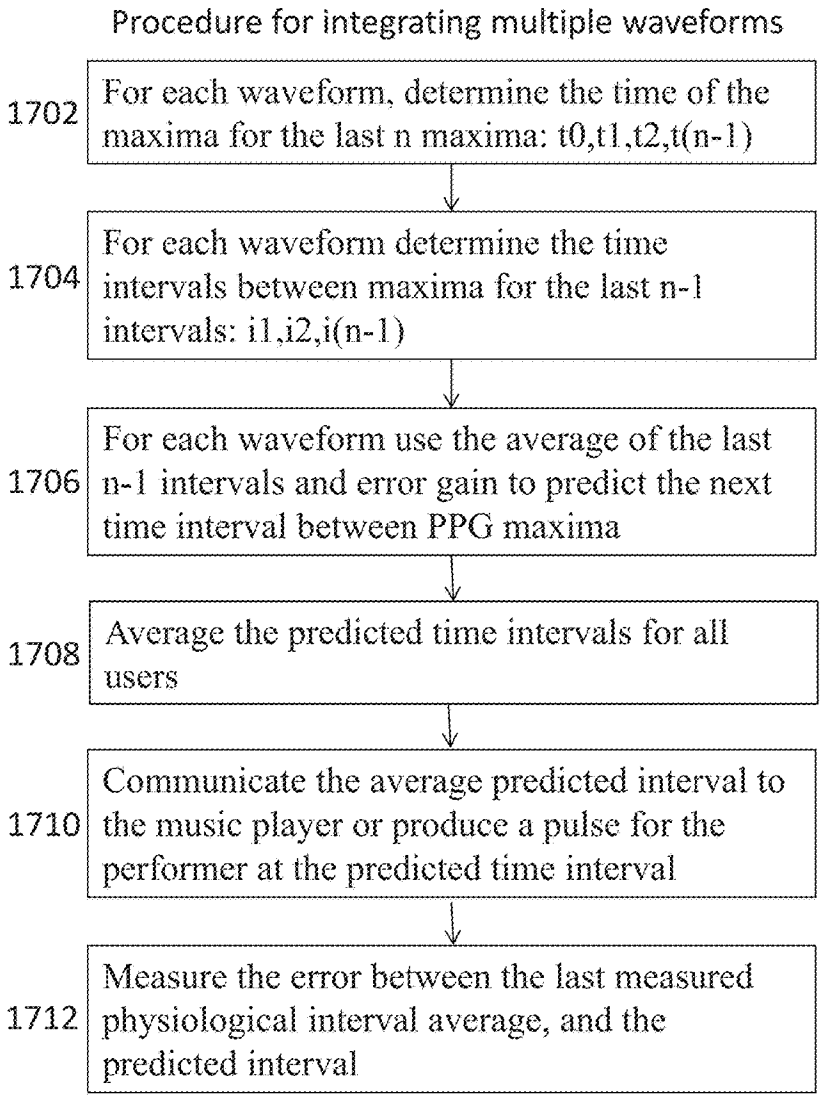
FIG. 17 is a flowchart illustrating a procedure for determining tempo based on input to the tempo generator from multiple users according to one embodiment of the present invention.

FIG. 17 shows another procedure for determining tempo based on input to the tempo generator from multiple users according to one embodiment of the present invention. This process is based on predicting the next physiological interval, such as the process described above with respect to FIG. 4, for each waveform, then taking the average of the predictions for use in the tempo generator. A weighted average can be used. The variables used here may defined as described above with respect to FIG. 3. In recording step 1702 the time of the maxima for the last n maxima in the PPG waveform are recorded in electronic memory: t0, t1, t2, t(n−1). In determination step 1704 the time intervals between PPG maxima for the last n−1 intervals is determined by subtraction i1=t0−t1, i2=t1−t2, i3=t2−t3, and so on. In step 1706, the average of the last n−1 intervals is taken and used together with the error (obtained in step 410 of FIG. 4 of past cycles) and error gain (set in the device as a factor to be multiplied with the error before adding the error to the next prediction) to predict the next time interval between PPG maxima. In calculation step 1708 the average of the predicted time intervals for all users is calculated. In communication step 1710 the predicted interval is communicated to the music player, or a pulse is produced for the performer at the predicted time interval. In calculation and recordation step 1712 the error or difference between the last measured physiological interval average, and the predicted interval is calculated and recorded.

Figure 18:
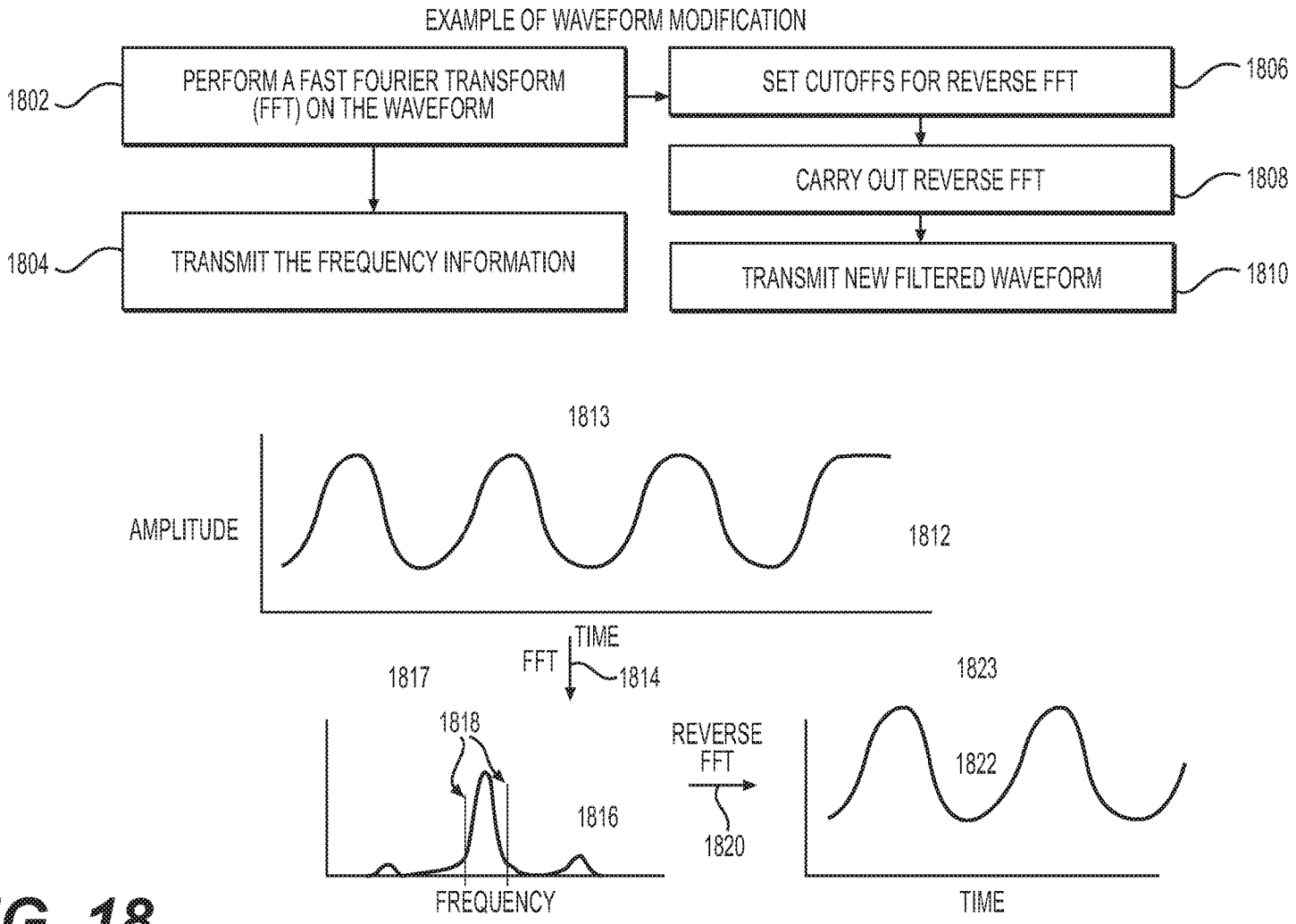
FIG. 18 is a flowchart and diagram illustrating an example of waveform modification and a set of three graphs according to one embodiment of the present invention.

FIG. 18 shows an example of a waveform modification according to one embodiment of the present invention. Fourier transform step 1802 performs a fast Fourier transform (FFT) on the waveform in order to convert the waveform from a time domain to a frequency domain. The length of time used for the FFT must be determined, and for instance can be from the last 5-30 iterations of the physiological rhythm. In transmission step 1804 the frequency information is transmitted to a tempo generator. Set cutoffs step 1806 sets cutoffs for in inverse or reverse FFT. Frequencies above or below a region of interest relevant to the music being generated can be cut out of the waveform in the frequency domain. Inverse FFT step 1808 carries out the inverse FFT on the modified waveform to produce a filtered waveform. In transmission step 1810 the new filtered waveform is transmitted. Waveform 1812 is hypothetical physiological waveform plotted as amplitude versus time on a graph 1813. Arrow 1814 indicates the carrying out of an FFT on waveform 1812. Waveform 1816 a waveform plotted in the frequency domain on a graph 1817. Arrows 1818 indicate cutoffs selecting frequencies selected for relevance to the tempo of the music. Arrow 1820 shows an inverse FFT being carried out on the filtered data which had certain frequencies removed from the waveform. Filtered waveform 1822 is filtered waveform plotted in the time domain on a graph 1823.

Figure 19:
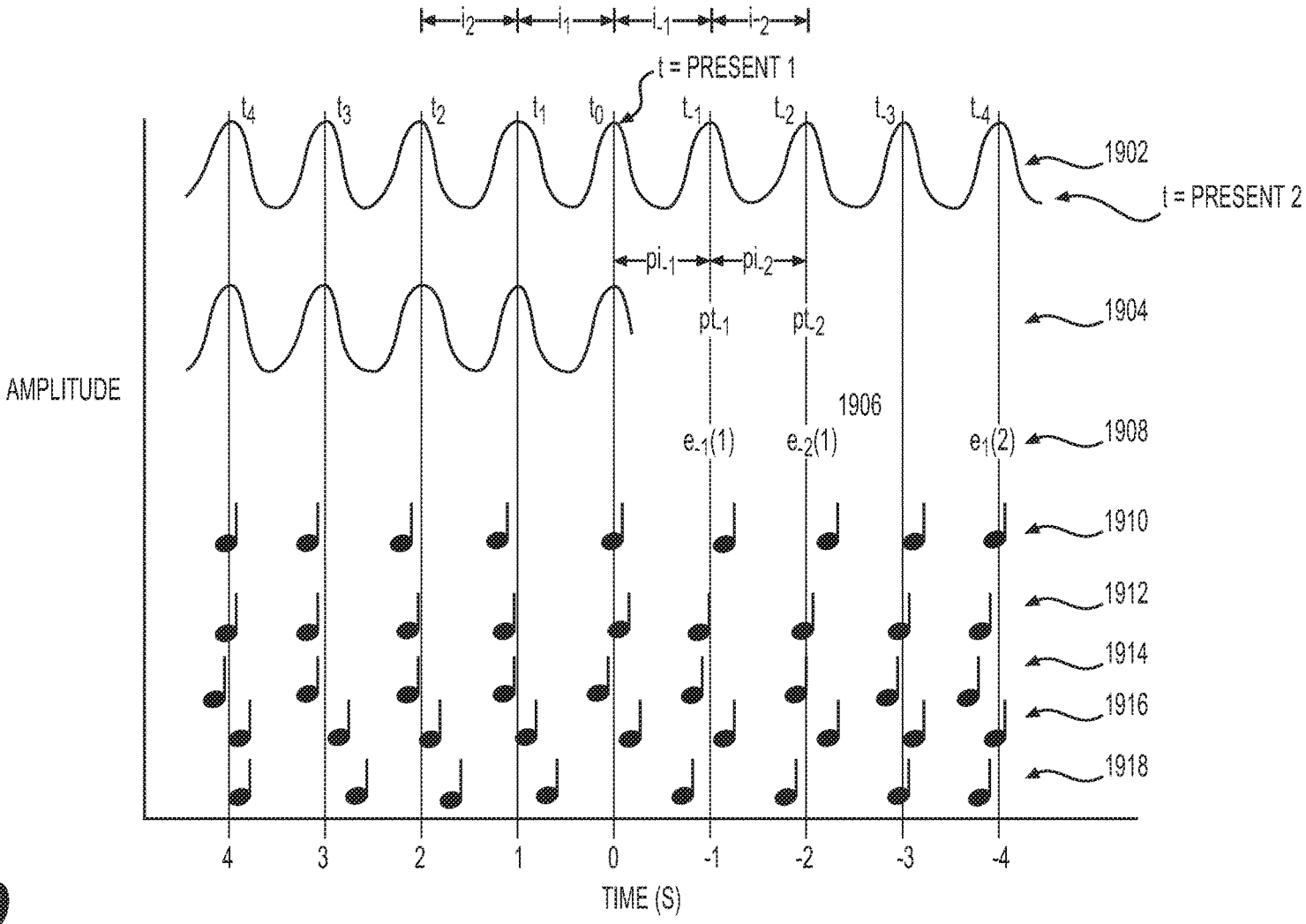
FIG. 19 is a diagram showing an example of a physiological waveform and the various tempo synchronizations made possible by the physiological metronome according to one embodiment of the present invention.

FIG. 19 shows an example of a physiological waveform and the various tempo synchronizations made possible by a physiological metronome according to one embodiment of the present invention. Physiological waveform 1902 is a physiological waveform plotted as amplitude vs time. Different parts of the waveform are labeled, including the time of the maxima indicated as tx where x is the number of the maxima from time=present 1. The intervals between maxima are labeled as ix where x is the number of the interval from time=present 1. The times of the maxima in the physiological waveform are indicated down the FIG. 19 by a line from the maxima I of physiological waveform 1902 down to the x axis. Level 1904 is a level of the graph that shows the physiological data that was available when t=present 1. In FIG. 19 pi-1 shows the predicted next interval for instance using the procedure described in FIG. 4. In FIG. 19 pi-2 is the predicted second interval using the information available at t=present 1. Since the data is being sent to the tempo generator in real time, the time of the "present" is steadily changing as time progresses. Therefore a second present, "present 2 " is also labeled in physiological waveform 1902 for the purpose of illustrating how different types of error can be generated and measured indicated in 1906 as e-1 (1) for the error for interval pi-1 from the prediction made at time=present 1 or e-2 (1) for the error for interval pi-2 from the prediction made at time=present 1 . Once more time has passed, error determined at time=present 2 is indicated as e-1 (2). Tempo 1910 is a regular musical tempo as produced by a typical metronome, with the time between beats being equal. Musical rhythm 1912 is an example of a musical rhythm or tempo that has been adjusted to be synchronous with the physiological rhythm, i.e. a physiologically synchronized musical tempo. The musical rhythm could also be adjusted to be asynchronous, phase shifted from the physiological rhythm, or at different frequencies that change proportionally to changes in the physiological frequencies. Tempo 914 is a physiologically synchronized musical tempo that has been phase shifted so that the musical beat takes place at a set interval before the maxima or distinguishing feature in the physiological waveform. Tempo 1916 is a physiologically synchronized musical tempo that has been phase shifted so that the musical beat takes place at a set interval after the maxima or distinguishing feature in the physiological waveform. Tempo 1918 is a physiologically synchronized musical tempo that has been adjusted to be played slower than the physiological rhythm. Such an effect can be controlled and tuned by the buttons such as buttons 728 or buttons 1308 in the control display of FIGS. 7 and 13, respectively.

Figure 20:
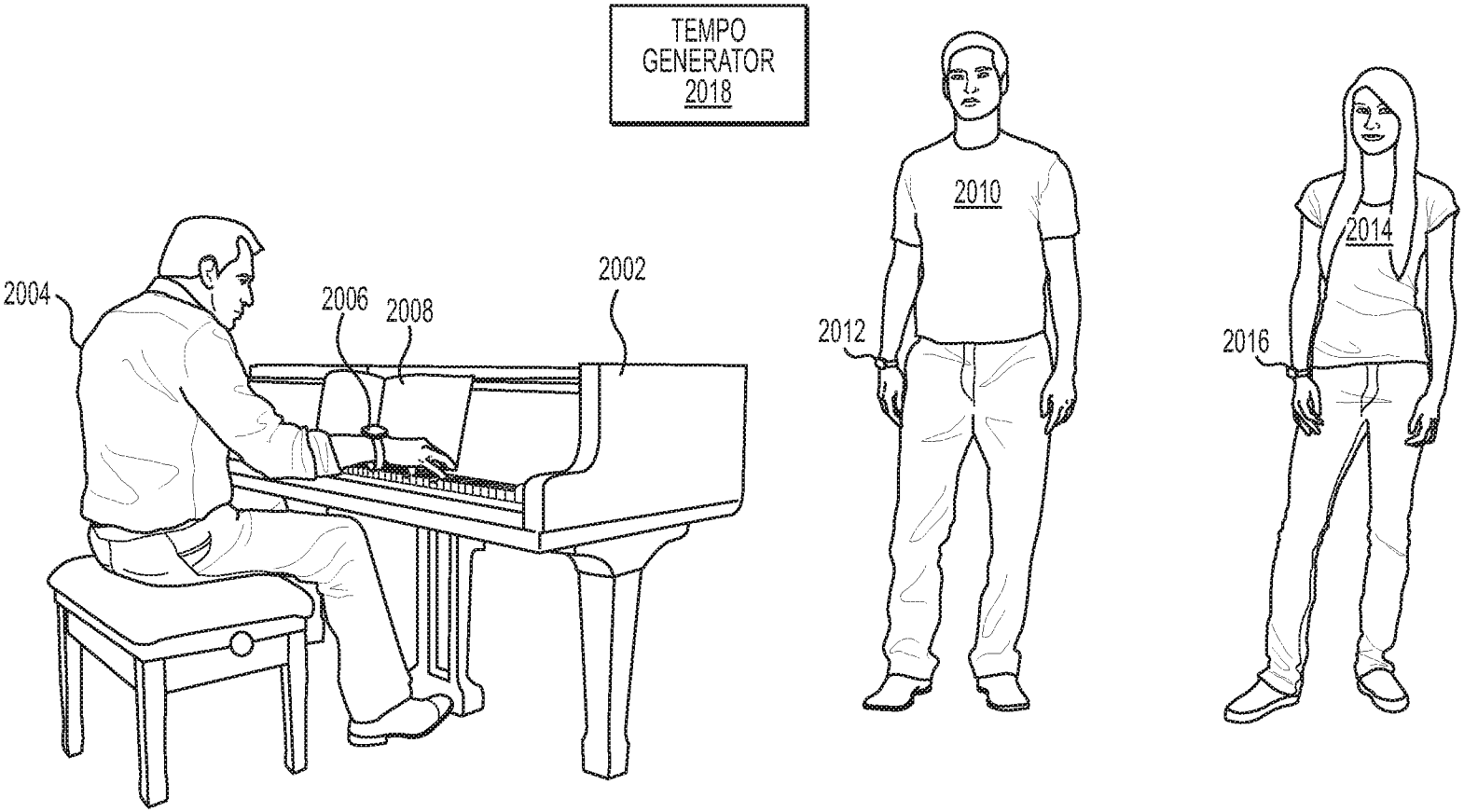
FIG. 20 is a diagram of a tempo generator being used for a musical performance according to one embodiment of the present invention.

FIG. 20 shows a temp generator being used for a musical performance according to one embodiment of the present invention. Musical instrument 2002 shown in FIG. 20 is a piano, but the musical instrument could be any musical instrument, including a guitar, violin, cello, bass, horn, electronic keyboard, drum, etc. FIG. 20 also shows a performer 2004 and a physiological waveform generator 2006 used by the performer. Physiological waveform generator 2006 can also be used to modulate tempos, with or without combinations with the listeners' physiological waveforms. Component 2008 is any of the components used to communicate the modulated tempo information to the performer in real time, in this case drawn as an optical display system such as that illustrated in FIG. 13. Listener 2010 is a listener who is listening to the performance, and physiological waveform 2012 is a physiological waveform generator used by the listener. Listener 2014 is a second listener and physiological waveform generator 2016 is a second physiological waveform generator used by a second listener. One or multiple users can simultaneously provide waveforms to tempo generator 2018, which sends the physiological waveform modulated tempo information to the performer via the display in component 2008 in real time.

Figure 21:
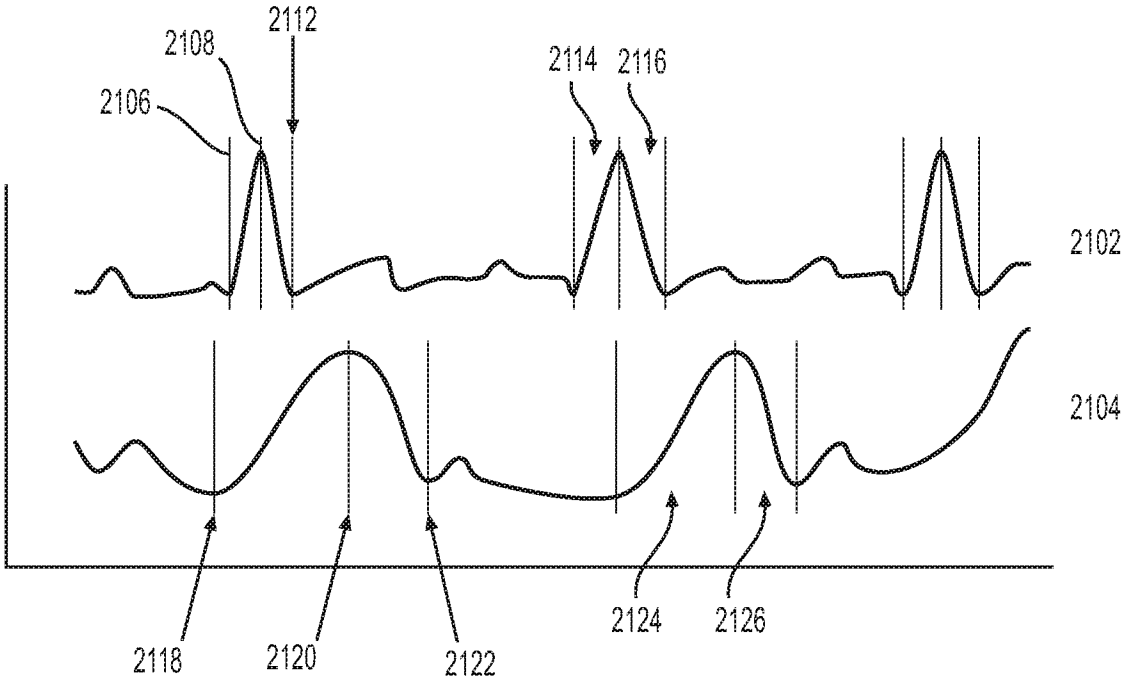
FIG. 21 is diagram showing two waveforms on a graph and showing examples of other features of the waveforms that can be used to determine time intervals according to one embodiment of the present invention.

FIG. 21 shows two waveforms and indicates examples of other features of the waveform that can be used to determine time intervals. Waveform 2102 is an ECG waveform plotted as amplitude versus time. Waveform 2104 is a PPG waveform plotted as amplitude versus time. Time 2106 is a time in the waveform where there is a sudden increase in the slope of the curve. Local maximum 2108 is a local maximum of the ECG waveform, which coincides with a sudden decrease in the slope of the curve. Such a sudden decrease could be used to mark time. Arrow 2112 points to a sudden increase in slope. This point could be used to mark time. Arrow 2114 points to a region of steady increase. The time of such a change in the signal can be used to mark time. Arrow 2116 points to a time sudden decrease. The time of such a change in signal can be used to mark time. Arrow 2118 points a time in the PPG waveform where there is a sudden increase in the slope of the curve. Arrow 2120 points to a local maximum of the PPG waveform, which coincides with a sudden decrease in the slope of the curve. Such a sudden decrease could be used to mark time. Arrow 2122 points to a sudden increase in slope. This point could be used to mark time. Arrow 2124 points to a region of steady increase. The time of such a change in the signal can be used to mark time. Arrow 2126 points to a sudden decrease. The time of such a change in signal can be used to mark tine.

Figure 22:
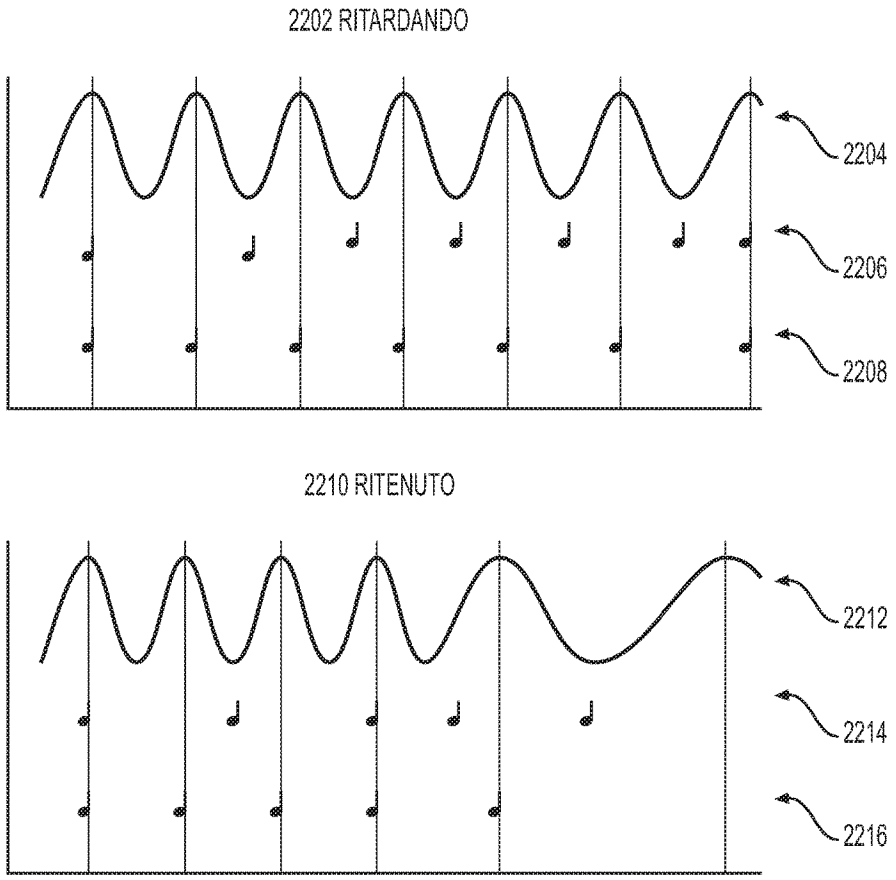
FIG. 22 is a drawing of two graphs of two different physiological waveforms according embodiments of the present invention.

FIG. 22 shows physiological rhythms that are speeding up plotted on the same timescale as musical rhythms with regular tempo and with physiologically modulated tempos synchronized with the physiological rhythm according to embodiments of the present invention. Graph 2202 shows a case where synchronizing the musical tempo with the physiological rhythm would cause a ritardando in the music. Physiological waveform 2204 is a physiological waveform that is gradually becoming slower. Tempo 2206 is a regularly timed tempo with the same number of musical time intervals as physiological intervals yet each musical time interval is of equal duration. Tempo 2208 shows the physiologically modulated tempo that is synchronized with the physiological rhythm. In this case synchronizing the musical tempo to the physiological rhythm causes a ritardando in the musical tempo.

Graph 2210 shows a case where synchronizing the musical tempo with the physiological rhythm would cause in a ritenuto in the music. Physiological waveform 2212 is a physiological waveform that quickly becomes slower. Tempo 2214 is a regularly timed tempo with the same number of musical time intervals as physiological intervals yet each musical time interval is of equal duration. Tempo 2216 is the physiologically modulated tempo that is synchronized with the physiological rhythm. In this case synchronizing the musical tempo to the physiological rhythm ritenuto in a ritardando in the musical tempo.

Figure 23:
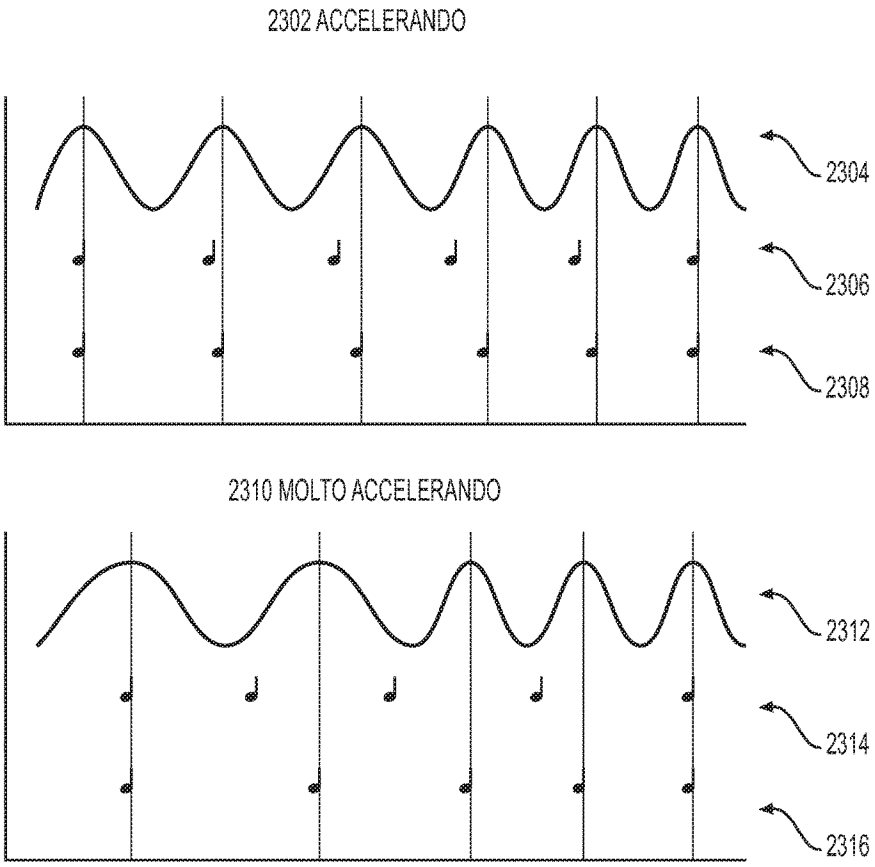

FIG. 23 shows physiological rhythms that are speeding up plotted on the same timescale as musical rhythms with regular tempo and with physiologically modulated tempos that are synchronized with the physiological rhythm according to embodiments of the present invention. Graph 2302 shows a case where synchronizing the musical tempo with the physiological rhythm would cause an accelerando in the music. Physiological waveform 2304 is a physiological waveform that is gradually speeding up. Tempo 2306 is a regularly timed tempo with the same number of musical time intervals as physiological intervals yet each musical time interval is of equal duration. Tempo 2308 is physiologically modulated tempo that is synchronized with the physiological rhythm. In this case synchronizing the musical tempo to the physiological rhythm causes an accelerando in the musical tempo.

Graph 2310 shows a case where synchronizing the musical tempo with the physiological rhythm would cause a molto accelerando in the music. Physiological waveform 2312 is a physiological waveform that quickly becomes faster. Tempo 2314 is a regularly timed tempo with the same number of musical time intervals as physiological intervals yet each musical time interval is of equal duration. Tempo 2316 is a physiologically modulated tempo that is synchronized with the physiological rhythm. In this case synchronizing the musical tempo to the physiological rhythm ritenuto in a ritardando in the musical tempo.

Figure 24:
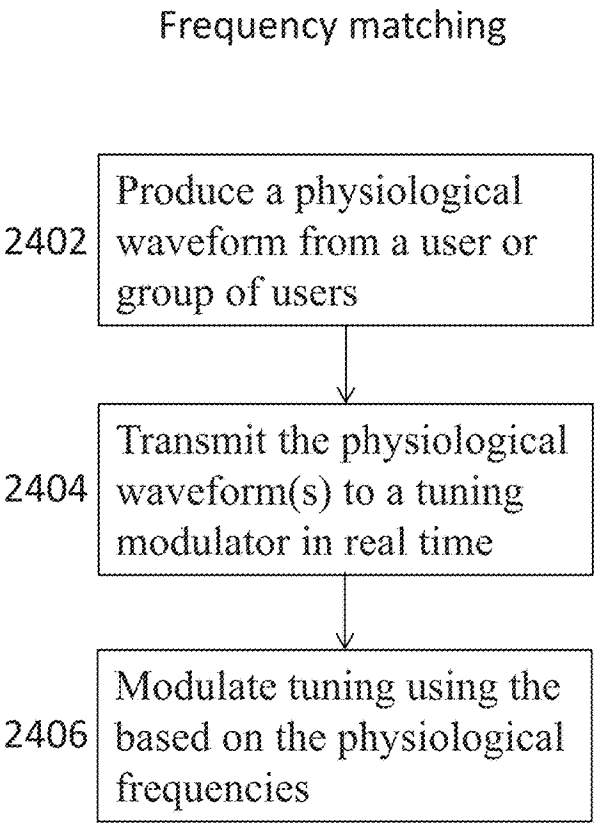
FIG. 24 is a flowchart of a frequency matching process according to one embodiment of the present invention.

FIG. 24 shows the components of a variation on the physiological metronome that could use physiological frequencies to vary pitch. In waveform generator 2402 a physiological waveform is produced by user or group of users. This could be carried out as described in FIG. 14. In transmitter 2404 the physiological waveform is transmitted to tuning modulator. Tuning modulator 2406 modulates the tuning of the song in response to the physiological rhythm.

Figure 25:
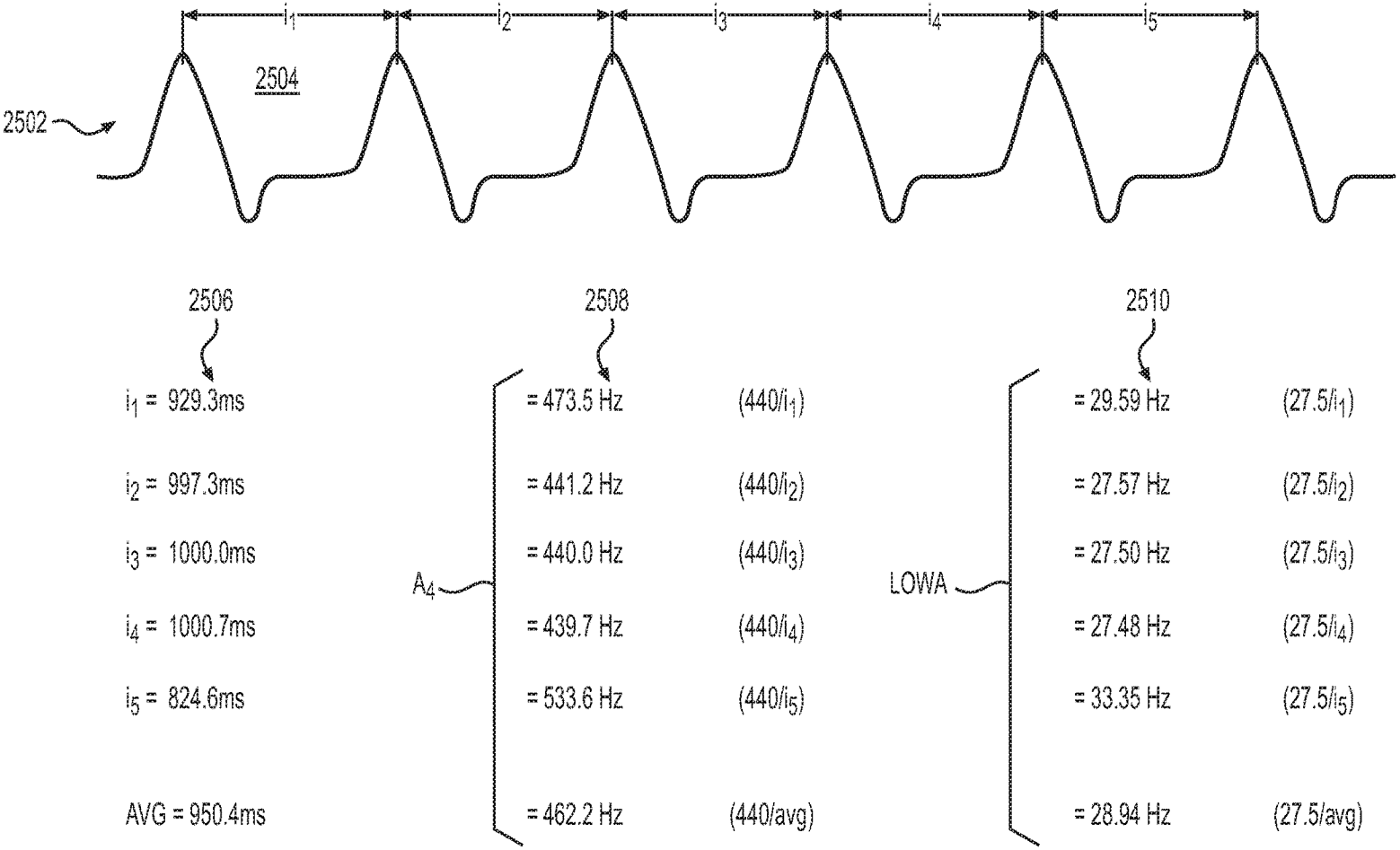
FIG. 25 is diagram showing an example of how the frequency matching process of FIG. 24 could be implemented according to one embodiment of the present invention.

FIG. 25 illustrates one way that the process described above and shown in FIG. 24 could work. Waveform 2502 is a physiological waveform. Intervals 2504 are five intervals between six maxima in the waveform, indicated by i1 , i2 , i3 , i4 , and i5. Case 2506 shows the time intervals in milliseconds (ms) for the intervals in the plot. The distances were measured in cm. Case 2506 assume that the duration of interval i3 is exactly 1s, and the durations of the other intervals are calculated by measurements of the relative widths of the time intervals in the plot and listed. The frequency matching process would then allow the tuning of a song to be adjusted to match the measured physiological intervals. For instance if the physiological frequency of the user changes from an average interval corresponding to i3 to an interval corresponding to i1 then the tuning of the music could be lowered such a note played at a particular frequency in the song would maintain the same number of acoustic oscillations per physiological rhythm. For instance, if a note with a frequency of 440 Hz (a concert pitch A4) is played during physiological rhythm i3 then the acoustic wave would oscillate 440 times in the time of one physiological rhythm. If that physiological rhythm increases in frequency, such that the physiological intervals correspond to i1 then the frequency matching device would adjust the frequency of all notes in a song accordingly, in this case to 473.5 Hz. Case 2508 shows how the frequency of the A4 note would be adjusted by a frequency modulator for the various intervals in case 2506. Case 2510 shows how the frequency of the low A on a piano would be adjusted using the frequency matching process. All notes in a song would be adjusted in pitch to match the physiological frequency. A musical instrument would require rapid automatic tuning for this to be useful. Electronic music however could quickly adjust the tuning of a song to match the physiological frequency in real time.

Figure 26:
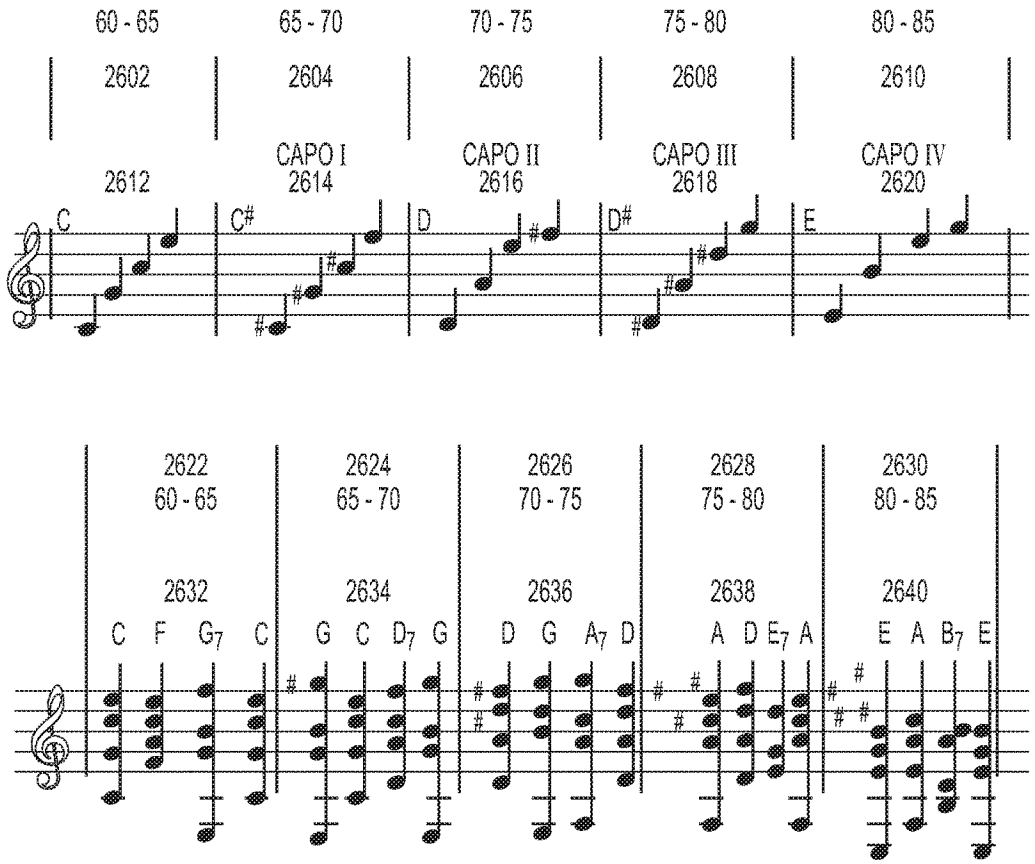
FIG. 26 is diagram showing where musical changes could be adapted in response to the measured physiological rhythm according to one embodiment of the present invention.

FIG. 26 shows an embodiment of the present invention where other musical changes could be adapted in response to the measured physiological rhythm. Ranges 2602, 2604, 2606 and 2610 are each a range of a set of physiological rhythm ranges, for instance a heartrate between 60-65 bpm for range 2602, 65-70 bpm for range 2604, 70-75 bpm for range 2606, and 75-80 bpm for range 2608, and 80-85 bpm for range 2610. The set physiological rhythm ranges could go to higher and lower frequencies, and have wider or smaller ranges in each category. Ranges 2612, 2614, 2616, 2618 and 2620 show changes in key corresponding to the physical ranges shown above them in the figure, and examples of musical passages that could be played at the different ranges. Different songs, melodies, rhythms, chord or note progressions could be played at the different physiological ranges. The transition from one musical theme to another for a different physiological rhythm can be timed to allow the first passage to be completed. For instance at a heartrate between 60-65 bpm for range 2612 would be played, at 65-70 bpm for range 2614 would be played, at 70-75 bpm for range 2616 would be played, at 75-80 bpm for range 2618 would be played, and at 80-85 bpm for range 2620 would be played. This embodiment could be done by electronically produced sound, or by a musical instrument that changes key, for instance by using a capo on the first fret of a guitar for range 2614, on the second fret for 2616, on the third fret for range 2618, on the fourth fret for range 2620, and so on. Instruments with automatic tuning such as an electronic keyboard could be used to rapidly change key to match the physiological rhythm in real time.

Ranges 2622, 2624, 2626, 2628, 2630, 2632, 2634, 2636, 2638 and 2640 are each a range of a set of ranges of a physiological rhythm, for instance a heartrate between 60-65 bpm for range 2622, 65-70 bpm for range 2624, 70-75 bpm for range 2626, and 75-80 bpm for range 2628, and 80-85 bpm for range 2630. The sets of physiological rhythm ranges could go to higher and lower frequencies, and have wider or smaller ranges in each category. Different songs, melodies, rhythms, chord or note progressions could be played at the different physiological ranges. The transition from one musical theme to another for a different physiological rhythm can be timed to allow the first passage to be completed. Ranges 2632, 2634, 2636, 2638 and 2640 show changes in key corresponding to the physical ranges shown above them in the figure, and chord progressions showing a major 1st chord, a major 4th chord and a major 5th7 chord for each key. For instance at a heartrate between 60-65 bpm for range 2632 would be played, at 65-70 bpm for range 2634 would be played, at 70-75 bpm for range 2636 would be played, at 75-80 bpm for range 2638 would be played, and at 80-85 bpm for range 2640 would be played.

Figure 27:
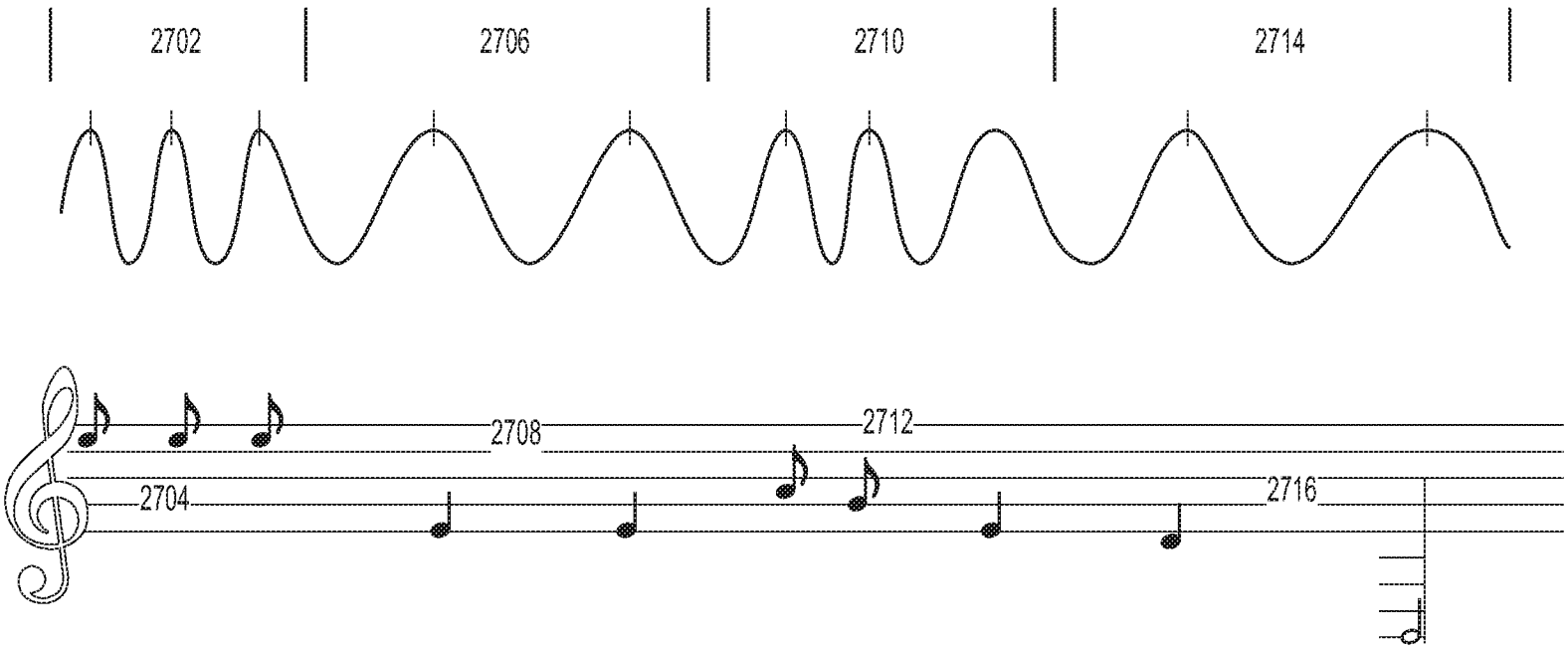
FIG. 27 is a diagram showing an example of a way to compose or control a progression of music using the physiological rhythms according to one embodiment of the present invention.

FIG. 27 shows an example of a way to compose or control the progression of music using the physiological rhythms Range 2702 is a range of a physiological rhythm with relatively high frequency. High pitched eighth notes are played at a tempo matching the physiological rhythm. Range 2706 shows a change in the physiological frequency to lower frequency. At music section 2708 lower pitched half notes are played at a physiologically matched tempo. Range 2710 shows a gradual decrease in the frequency of the physiological rhythm. Music section 2712 shows a gradual decrease in the pitch of the musical notes and an increase in the duration. Range 2714 shows a further decrease in the frequency of the physiological rhythm, and music section 2716 shows a further decrease in the pitch and duration of the musical notes. Higher frequency physiological rhythms could also be used to signal a lowering of pitch or tempo.

Figure 28:
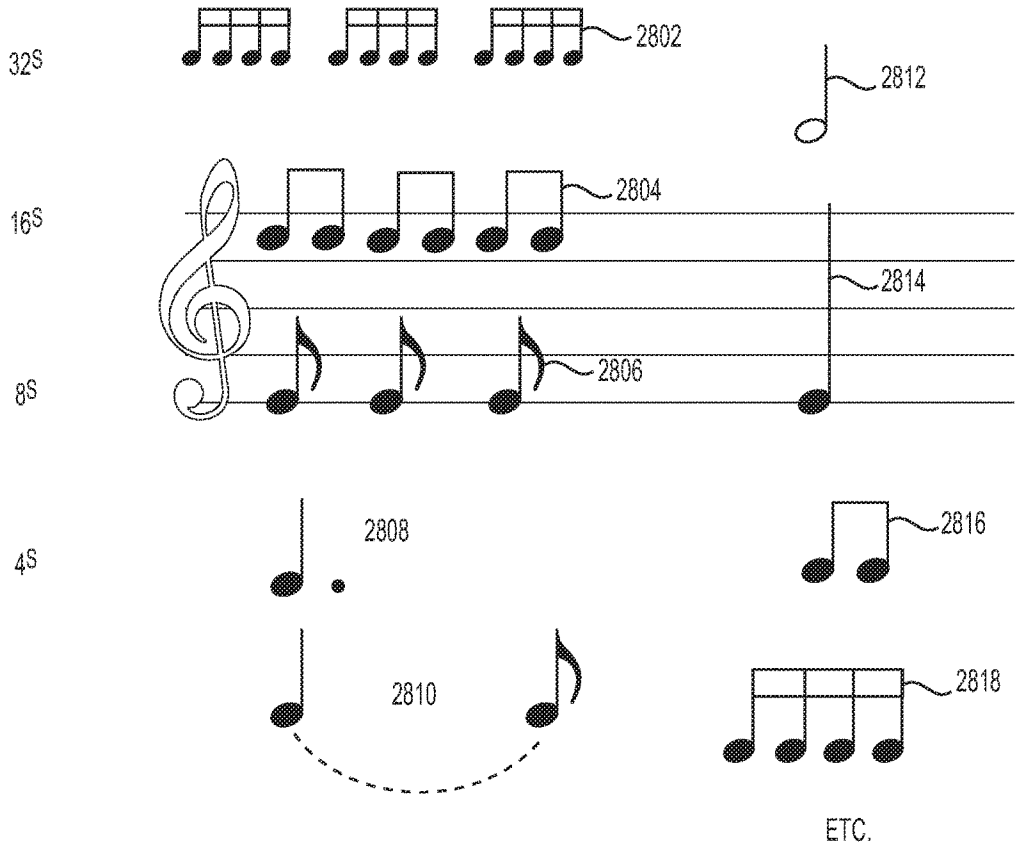
FIG. 28 is a diagram showing an example of the idea to correlate pitch and rhythm by illustrating different tempos at different pitches according to one embodiment of the present invention.

FIG. 28 shows an example of the idea to correlate pitch and rhythm by illustrating different tempos at different pitches. Notes 2802, notes 2804, notes 2806, and note 2808 show the idea to use faster rhythms at higher pitch and slower rhythms at lower pitch. Notes 2802 are 32nd notes played at very high pitch. Notes 2804 are 16th notes played at high pitch. Notes 2806 are eighth notes played at intermediate pitch. Note 2808 is a dotted quarter note played at very low pitch. Note 2810 is another way to write a dotted quarter note, played at a very low pitch. Note 2812, note 2814, note 2816 and note-2818 show the reverse idea i.e., to play slower rhythms at higher pitch, and faster rhythms at lower pitch. Note 2812 is a half note played at high pitch. Note 2814 is a quarter note played at intermediate pitch. Note 2816 is an eighth notes played at low pitch. Note 2818 is 16th notes played at very low pitch.

Figure 29:
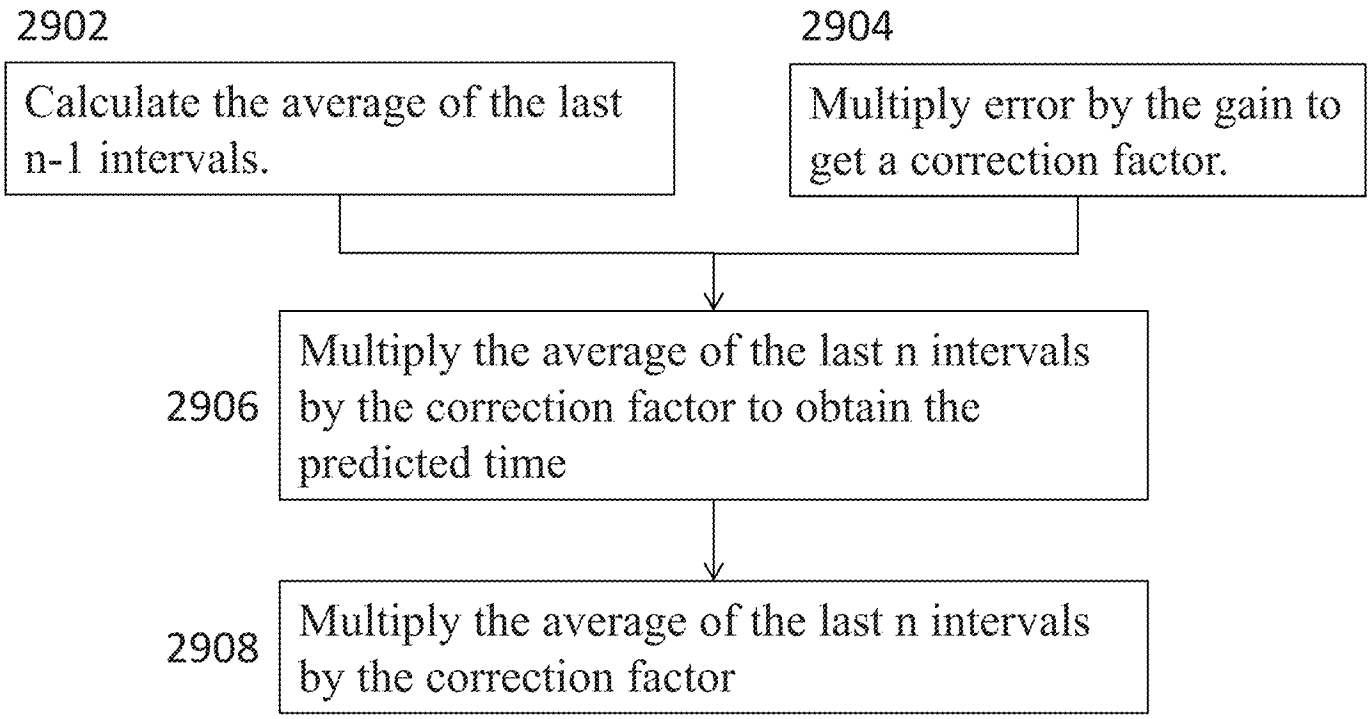
FIG. 29 is a flowchart showing how each waveform uses the average of the last n−1 intervals and error gain to predict the next time interval between PPG maxima according to one embodiment of the present invention.

FIG. 29 shows an elaboration of step 1706, i.e., "For each waveform use the average of the last n−1 intervals and error gain to predict the next time interval between PPG maxima,"

according to one embodiment of the present invention. A calculation step 2902 the average of the last n−1 intervals is calculated. At multiplication step 2904 the error is multiplied by the gain to get a correction factor. At multiplication step 2906 the average of the last n intervals is multiplied by the correction factor to obtain the predicted time. At multiplication step 2908 the average of the last n intervals is multiplied by the correction factor.

Figure 30:
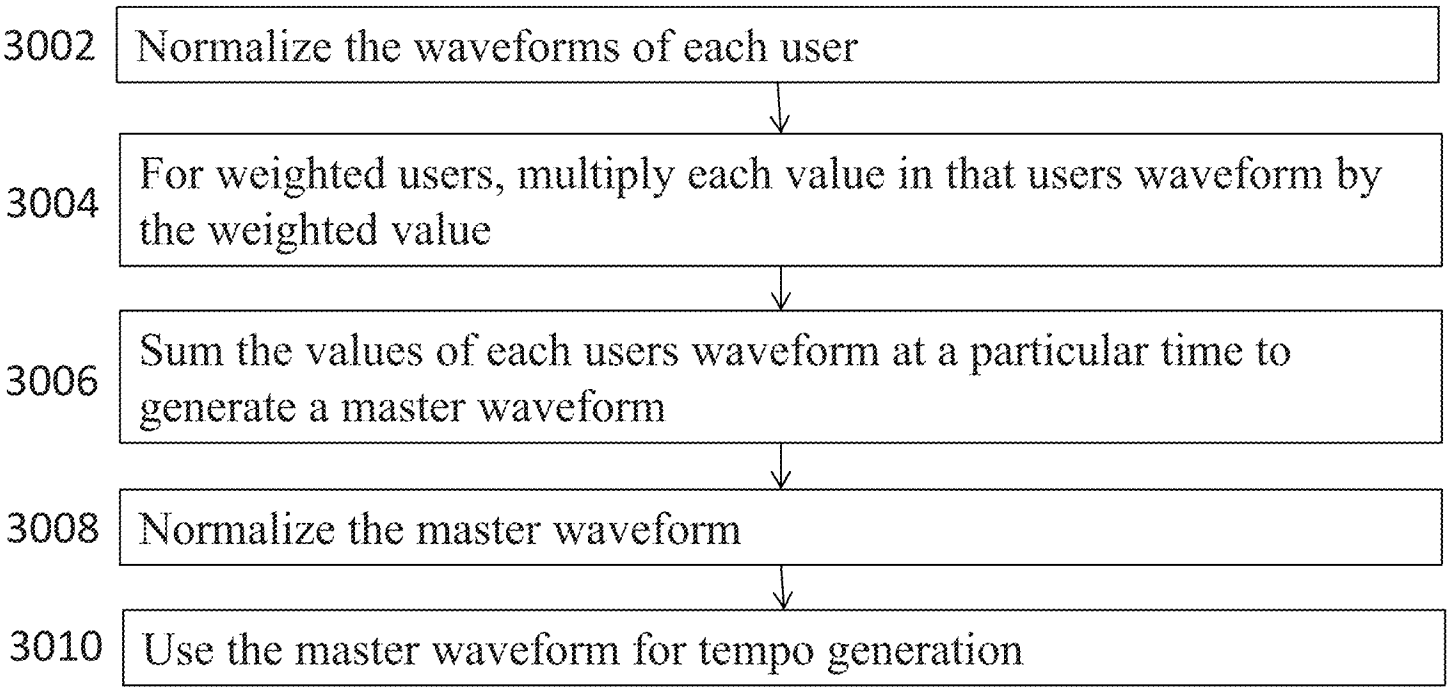
FIG. 30 is a flowchart showing how to carry out a mathematical operation between the values obtained within set time ranges according to one embodiment of the present invention.
Figure 31:
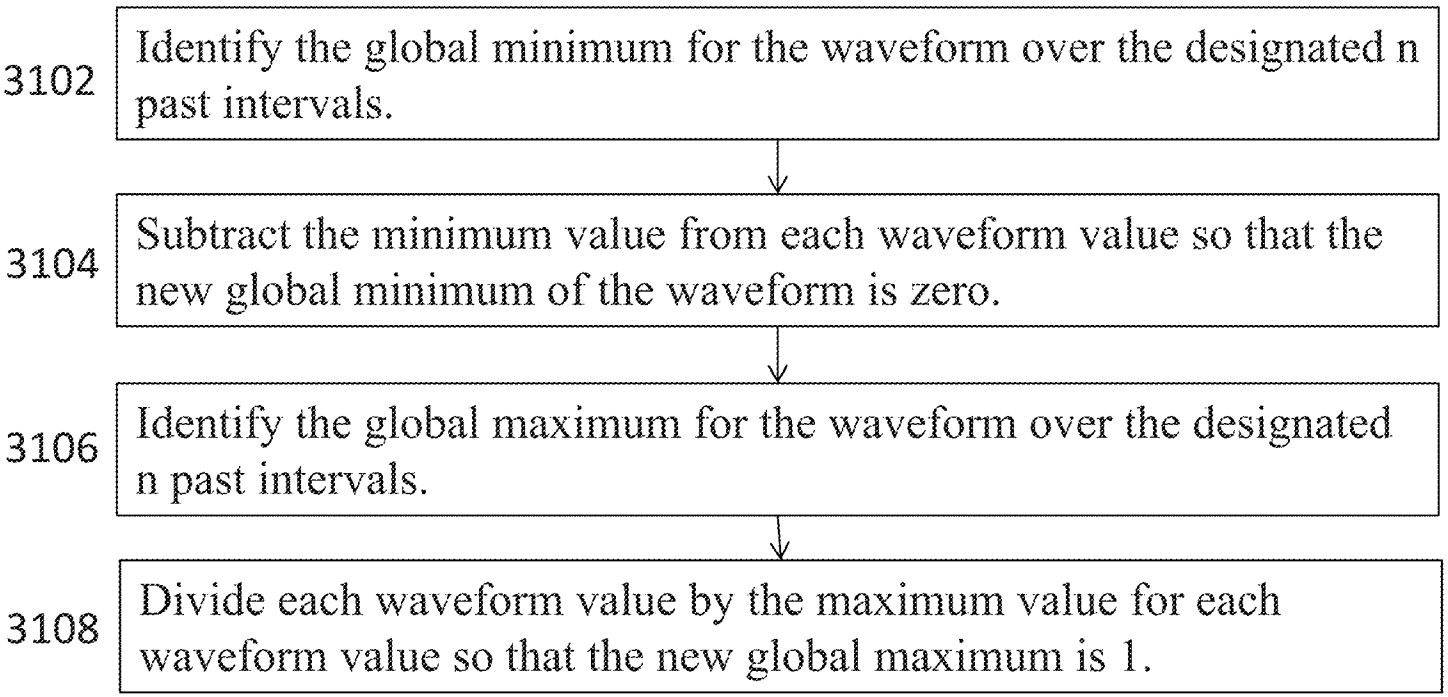
FIG. 31 is a flowchart showing a normalization procedure that can be carried out on waveform data according to one embodiment of the present invention.

FIG. 30 shows an elaboration on operation step 1606, i.e., "carry out a mathematical operation between the values obtained within set time ranges," according to one embodiment of the present invention. At normalization step 3002 the waveforms of each user are normalized. An example of a normalization procedure is shown in FIG. 31. At multiplication step 3004, for weighted users, each value in that user's waveform is multiplied by the weighted value. At waveform generation step 3006 is the values of each user's waveform are summed at a particular time to generate a master waveform. At normalization step 3008 the master waveform is normalized. At tempo generation step 3010 the master waveform is used for tempo generation.

FIG. 31 shows a normalization procedure that can be carried out on waveform data. At identification step 3102 the global minimum for the waveform over the designated n past intervals is identified. At step 3104 the minimum value is subtracted from each waveform value so that the new global minimum of the waveform is zero. At identification step 3106 the global maximum for the waveform over the designated n past intervals is identified. At step 3108 each waveform value is divided by the maximum value for the waveform so that the new global maximum is 1.

In one embodiment of the present invention, the stability of the measurement of beats may be addressed. For example, if a physiological metronome or other device of the present invention is not measuring a couple beats properly, the metronome or other device may recognize this fact and maintain tempo.

In one embodiment of the present invention, the speed of waveform data is transmitted to a tempo generator at a speed faster than the tempo.

In one embodiment, the present invention provides a physiological metronome, such as an ECG metronome or a PPG metronome that that will allow using the physiological rate of a musician or audience to control and/or adjust the tempo of music.

In one embodiment, the present invention provides a physiological metronome, such as an ECG metronome or a PPG metronome that that will allow using feedback to synchronize, and allow phase and gain adjustments.

In one embodiment, the present invention provides a device that employ one or more physiological rate measurements, such as ECG or PPG measurements that can play electronic music controlled by physiological feedback to allow using a physiological rate to control and/or adjust the tempo of the music.

In one embodiment, the present invention provides a device that employ one or more physiological rate measurements, such as ECG or PPG measurements that can play electronic music controlled by physiological feedback to allow using feedback to synchronize, and allow phase and gain adjustments of the music.

In one embodiment, the present invention provides a device that employ one or more physiological rate measurements, such as ECG or PPG measurements that can play electronic music controlled by physiological feedback to allow a user to do this with the user's favorite songs and/or allow recording to play at different speeds with or without pitch changes.

In one embodiment, the present invention provides a device that employ one or more physiological rate measurements, such as ECG or PPG measurements that can play electronic music controlled by physiological feedback to allow a user to compose new songs that are compatible with the physiological feedback.

In one embodiment, the present invention provides a device that employ one or more physiological rate measurements, such as ECG or PPG measurements that can play electronic music controlled by physiological feedback to allow changes in tuning and the song to match physiological states.

In one embodiment, the present invention provides a method for matching tempo with physiological rhythm (not necessarily considering phase).

In one embodiment, the present invention provides a method for synchronizing tempo with physiological rhythm (considering phase).

In one embodiment, the present invention provides a method for predicting beats in real time such as the next beat, the $2^{nd}$ next beat and the nth next beat.

In one embodiment, the present invention provides a method for determining error between prediction and using that measurement as gain In one embodiment, the present invention provides a method for phase shifting based on one or more physiological rhythms.

In one embodiment, the present invention provides a method for increasing or decreasing tempo relative to a physiological rhythm.

In one embodiment, the present invention provides two methods integrating multiple waveforms for performances. One way of integrating multiple waveforms from multiple listeners is to carry out mathematically weighted operations between the waveforms to generate a single waveform. The weighting can be determined based on the amount of error between the predicted beats of music and the actual beats of music. For instance in the case that some user's measurements are more or less accurate, or more or less useful in the production of sympathetic music, or music that matches the physiological rhythms of the audience. Another way of integrating multiple waveforms from multiple listeners is to determine the predicted interval for each waveform, then average the predictions. The value of the predictions in the averaging can be weighted according to the errors determined by based on the amount of error between the predicted beats of music and the actual beats of music.

In one embodiment, the present invention provides a method for frequency matching for tuning. In the case of music played by the device, the tuning of the music can be adjusted to match the physiological rhythm of the listener or listeners. That is, the pitch of each note in a song would be adjusted by an amount determined by changes in the listeners physiological rhythm. FIGS. 24 and 25 show an example of this concept.

In one embodiment, the present invention provides a method for distinguishing physiological rhythms.

In one embodiment, the present invention provides a method for categorize and make musical decisions based upon physiological rhythms, such as making changes in key based on physiological rhythms. This idea would be to produce a song where a different musical pattern is played as a function of the different physiological rhythms, for instance different keys, melodies, rhythms, or chord or note progressions could be played at the different physiological ranges. FIGS. 26, 27 and 28 illustrate examples of this idea. The transition from one musical theme to another for a different physiological rhythm can be timed to allow the first passage, melody, or other musical pattern to be completed based on a physiological rhythm.

In one embodiment, the present invention may be implemented in a specific application such as a health resource, for example, as a fitness or activity tool. Thus, in a disclosed embodiment, a user may utilize their target hart rate in conjunction with music using the tempo modulated by the user's physiological rhythm in real time. In accordance with the disclosed invention, music generator 112 produces music using the tempo modulated by the user's physiological rhythm in real time. The music can be produced by a performer who receives rhythmic information from the tempo generator (illustrated in FIG. 10), or by a music producing machine that uses the input from the tempo generator to modulate the tempo of the music. A target heart rate may be established in accordance with a user's physiological rhythm. A song tempo may be established or adjusted in accordance with the target heart rate based upon a user's physiological rhythm. For example, when a user's target heart rate is set, and that user establishes that set heart rate after beginning a fitness activity such as exercising or another increased activity, their song is played at the tempo they are used to, i.e., at the tempo of the target heart rate. If the user's heart rate goes above the set target heart rate, then the user's song speeds up to match the increased heart rate. If the user's heart rate goes below the set target heart rate, then the user's song slows down accordingly.

In an alternate embodiment, the user physiological rhythm may be utilized along with song tempo to indicate that an adjustment may need to be made to a user's heart rate. For example, after a user begins an increased activity, such as a fitness activity/exercising, and establishes a target heart rate, if the user's heart rate goes above the set target heart rate, then the user's song may be configured to slow down. This indicates a need to the user to decrease activity and thereby slow down the heart rate until the target heart rate is met. If the user's heart rate goes below the set target heart rate, then the user's song may be configured to speed up. This indicates a need to the user to increase activity and thereby increase the heart rate until the target heart rate is met. In this manner, a user may establish a maintain a targeted heart rate utilizing their own physiological rhythm.

All documents, patents, journal articles and other materials cited in the present application are incorporated herein by reference.

While the present invention has been disclosed with references to certain embodiments, numerous modification, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A system comprising:

a physiological metronome comprising a tempo generator and a display apparatus;

wherein the tempo generator is configured to generate a modulated tempo for a music performed by a musician in real time based on a physiological rhythm of the musician and one or more settings;

wherein the display apparatus is configured to allow visualization of the modulated tempo and the one or more settings;

wherein the display apparatus comprises one or more setting controllers configured to allow adjustment of the one or more settings; and wherein the one or more settings comprise a setting for tempo synchronization, a setting for phase shift between the physiological rhythm and a music tempo, or a setting for error gain.

2. The system of claim 1, wherein the physiological metronome is an electrocardiography (ECG) metronome and wherein the physiological rhythm is a measurement of electrical activity in the heart of the musician.

3. The system of claim 1, wherein the physiological metronome is a photoplethysmography (PPG) metronome and wherein the physiological rhythm is a measurement of blood flow or blood pressure of the musician.

4. The system of claim 1, comprising a feedback system configured to inform the musician the modulated tempo.

5. The system of claim 4, wherein the feedback system comprises a speaker, headphone, optical system, and/or a visual display screen.

6. The system of claim 4, wherein the modulated tempo is informed to the musician in a form of sound, visual information, tactile information, or a delivery of therapeutic agents or treatments at frequencies modulated by physiological rhythms.

7. The system of claim 1, wherein the physiological metronome is an electroencephalography (EEG) metronome.

8. The system of claim 1, wherein the physiological rhythm is a measurement of electrical activity in different parts of the brain of the musician.

9. The system of claim 1, wherein the system comprises a band having a first side that is contactable to musician's skin and a second side opposite to the first side;

wherein the first side of the band includes:

one or more sensors configured to measure one or more physiological rhythms of the musician, a processor configured to generate a physiological waveform from a measured physiological rhythm of the musician, transmit data of the physiological waveform to the tempo generator, and receive modulated tempo information from the tempo generator; and a tempo communicator configured to inform the musician the modulated tempo in real time; and wherein the second side of the band includes the tempo generator and the display apparatus.

10. The system of claim 9, wherein the tempo communicator is a tactile rhythm communicator.

11. The system of claim 1, further comprising a band separated from the tempo generator and the display apparatus, wherein the band comprising:

a sensor configured to measure a physiological rhythm of the musician, a processor configured to generate a physiological waveform from a measured physiological rhythm of the musician, transmit data of the physiological waveform to the tempo generator, and receive modulated tempo information from the tempo generator; and a tempo communicator configured to inform the musician the modulated tempo in real time.

12. The system of claim 11, wherein the tempo communicator is a tactile rhythm communicator.

13. The system of claim 1, further comprising a music generator configured to produce a music using the modulated tempo.

14. A system comprising:

a physiological metronome configured to provide a modulated tempo for a music performed by a musician or by a machine in real time based on an integrated physiological waveform of one or more physiological waveforms of one or more members of an audience listening to the music;

wherein the physiological metronome comprises a tempo generator and a display apparatus;

wherein the tempo generator is configured to generate a modulated tempo for the music based on the integrated physiological waveform and one or more settings;

wherein the display apparatus is configured to allow visualization of the modulated tempo and the one or more settings;

wherein the display apparatus comprises one or more setting controllers configured to allow adjustment of the one or more settings; and wherein the one or more settings comprise a setting for tempo synchronization, a setting for phase shift between the integrated physiological waveform and a tempo of the music, or a setting for error gain.

15. The system of claim 14, wherein each of the one or more physiological waveforms is a measurement of electrical activity in a heart of a member of the audience.

16. The system of claim 14, wherein each of the one or more physiological waveforms is a measurement of blood flow or blood pressure of a member of the audience.

17. The system of claim 14, comprising a feedback system configured to inform the one or more members of the audience the modulated tempo.

18. The system of claim 14, wherein each of the one or more physiological waveforms is a measurement of electrical activity in different parts of the brain of a member of the audience.

19. A system comprising a device configured to synchronize, and allow phase and error adjustments of a music played by the device based on one or more physiological rhythms of one or more members of an audience listening to the music played by the device;

wherein the device comprises a tempo generator and a display apparatus;

wherein the tempo generator is configured to generate a modulated tempo for the music based on an integrated physiological waveform generated from the one or more physiological rhythms, and one or more settings;

wherein the display apparatus is configured to allow visualization of the modulated tempo and the one or more settings;

wherein the display apparatus comprises one or more setting controllers configured to allow adjustment of the one or more settings; and wherein the one or more settings comprise a setting for tempo synchronization, a setting for phase shift between the integrated physiological waveform and a tempo of the music, or a setting for error gain.

20. The system of claim 19, wherein each of the one or more physiological rhythms is a measurement of electrical activity in the heart of a member of the audience.

21. The system of claim 19, wherein each of the one or more physiological rhythms is a measurement of blood flow or blood pressure of a member of the audience.

22. The system of claim 19, wherein each of the one or more physiological rhythms is a measurement of electrical activity in different parts of the brain of a member of the audience.

23. A system comprising:

a device configured to play a recorded music at one or more speeds with or without pitch changes using a modulated tempo generated based on an integrated physiological waveform generated from one or more physiological rhythms of one or more members of an audience listening to the recorded music; and a physiological metronome comprising a tempo generator and a display apparatus;

wherein the tempo generator is configured to generate a modulated tempo for the recorded music based on the integrated physiological waveform and one or more settings;

wherein the display apparatus is configured to allow visualization of the modulated tempo and the one or more settings;

wherein the display apparatus comprises one or more setting controllers configured to allow adjustment of the one or more settings; and wherein the one or more settings comprise a setting for tempo synchronization, a setting for phase shift between the integrated physiological waveform and a tempo of the recorded music, or a setting for error gain.

24. The system of claim 23, wherein each of the one or more physiological rhythms is a measurement of electrical activity in a heart of a member of the audience.

25. The device system of claim 23, wherein each of the one or more physiological rhythms is a measurement of blood flow or blood pressure a member of the audience.

26. The system of claim 23, wherein each of the one or more physiological rhythms is a measurement of electrical activity in different parts of the brain of a member of the audience.

27. A system comprising a tempo generator and a display apparatus;

wherein the tempo generator is configured to produce a modulated tempo for a music played by a musician or by a machine based on an integrated physiological waveform and one or more settings;

wherein the integrated physiological waveform is generated from one or more physiological waveforms of one or more users;

wherein the display apparatus is configured to allow visualization of the modulated tempo and the one or more settings;

wherein the display apparatus comprises one or more setting controllers configured to allow adjustment of the one or more settings; and wherein the one or more settings comprise a setting for tempo synchronization, a setting for phase shift between the integrated physiological waveform and a tempo of the music, or a setting for error gain.

28. The system of claim 27, wherein each of the one or more physiological waveforms is a measurement of electrical activity in the heart of a user.

29. The system of claim 27, wherein each of the one or more physiological waveforms is a measurement of blood flow or blood pressure of one user.

30. The system of claim 27, wherein the integrated physiological waveform is generated from two or more physiological waveforms of two or more users; and wherein the two or more users comprise at least one musician playing the music and at least one audience member listening to the music played by the musician.

31. The system of claim 27, comprising a feedback system configured to inform the one or more users the modulated tempo.

32. The system of claim 27, wherein each of the one or more physiological waveforms is a measurement of electrical activity in different parts of the brain of a user.

33. A system comprising:

a device configured to adjust tuning of a music played by the device based on frequencies of an integrated physiological waveform generated from one or more physiological waveforms of one or more members of an audience listening to the music played by the device, and a physiological metronome comprising a tempo generator and a display apparatus;

wherein the tempo generator is configured to generate a modulated tempo for the music based on the integrated physiological waveform and one or more settings;

wherein the display apparatus is configured to allow visualization of a tempo synchronized to the integrated physiological waveform and the one or more settings;

wherein the display apparatus comprises one or more setting controllers configured to allow adjustment of the one or more settings; and wherein the one or more settings comprise a setting for the tempo synchronization, a setting for phase shift between the integrated physiological waveform and a tempo of the music, or a setting for error gain.

34. The system of claim 33, wherein each of the one or more physiological waveforms is a measurement of electrical activity in the heart of a member of the audience.

35. The system of claim 33, wherein each of the one or more physiological waveforms is a measurement of blood flow or blood pressure of a member of the audience.

36. The system of claim 33, wherein each of the one or more physiological waveforms is a measurement of electrical activity in different parts of the brain of a user.

37. A method comprising:

synchronizing a tempo of a music played by a musician or a machine to a physiological waveform of a user in real time according to one or more settings, thereby generating a modulated tempo for the music;

wherein the one or more settings are configured to be visualized on a display apparatus and to be adjusted by the user;

wherein the display apparatus comprises one or more setting controllers configured to allow adjustment of the one or more settings;

wherein the one or more settings comprise a setting for the tempo synchronization, a setting for phase shift between the physiological waveform and a tempo of the music, or a setting for error gain; and wherein the user comprises a musician and/or a member of an audience listening to the music.

* * * * *